US010701508B2

(12) United States Patent
Hamada et al.

(10) Patent No.: US 10,701,508 B2
(45) Date of Patent: Jun. 30, 2020

(54) INFORMATION PROCESSING APPARATUS, INFORMATION PROCESSING METHOD, AND PROGRAM

(71) Applicant: SONY CORPORATION, Tokyo (JP)

(72) Inventors: Toshiya Hamada, Saitama (JP); Nobuaki Izumi, Kanagawa (JP); Yukara Ikemiya, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/323,591

(22) PCT Filed: Jun. 23, 2017

(86) PCT No.: PCT/JP2017/023173
§ 371 (c)(1),
(2) Date: Feb. 6, 2019

(87) PCT Pub. No.: WO2018/055860
PCT Pub. Date: Mar. 29, 2018

(65) Prior Publication Data

US 2019/0174247 A1 Jun. 6, 2019

(30) Foreign Application Priority Data

Sep. 20, 2016 (JP) ..... 2016-182741

(51) Int. Cl.

| | |
|---|---|
| ***H04S 7/00*** | (2006.01) |
| ***H04R 5/02*** | (2006.01) |
| ***H04S 3/00*** | (2006.01) |
| ***H04R 5/04*** | (2006.01) |

(52) U.S. Cl.
CPC ..... *H04S 7/303* (2013.01); *H04R 5/02* (2013.01); *H04R 5/04* (2013.01); *H04S 3/008* (2013.01); *H04S 7/304* (2013.01); *H04S 7/40* (2013.01); *H04S 2400/01* (2013.01); *H04S 2400/11* (2013.01); *H04S 2400/15* (2013.01)

(58) Field of Classification Search
CPC .... H04S 2400/15; H04S 2400/11; H04S 7/40; H04S 1/007
See application file for complete search history.

(56) References Cited

U.S. PATENT DOCUMENTS

2006/0109988 A1* 5/2006 Metcalf

FOREIGN PATENT DOCUMENTS

JP 2010-028620 A 2/2010

* cited by examiner

*Primary Examiner* — Kile O Blair
(74) *Attorney, Agent, or Firm* — Paratus Law Group, PLLC

(57) ABSTRACT

A sound source setting section and a listening setting section are each configured to have a parameter setting section, a display section, and an arrangement relocation section on a placing surface of a placing table in real space, the arrangement relocation section allowing the source setting and listening sections to relocate on the placing surface. A reflecting member to which a reflecting characteristic is assigned is configured to be placeable on the placing table. A mixing process section performs a mixing process and also generates an image at the position, in a virtual space, of the sound source setting section relative to the listening setting section, the image having a texture indicative of a sound source assigned to the sound source setting section. Sound mixing with respect to a free listening point is thus performed easily.

20 Claims, 17 Drawing Sheets

(a)

(b)

(a)

(b)

(b)

(a)

(a)

(b)

(c)

(d)

INFORMATION PROCESSING APPARATUS, INFORMATION PROCESSING METHOD, AND PROGRAM

CROSS REFERENCE TO PRIOR APPLICATION

This application is a National Stage Patent Application of PCT International Patent Application No. PCT/JP2017/023173 (filed on Jun. 23, 2017) under 35 U.S.C. § 371, which claims priority to Japanese Patent Application No. 2016-182741 (filed on Sep. 20, 2016), which are all hereby incorporated by reference in their entirety.

TECHNICAL FIELD

The present technology relates to an information processing apparatus, an information processing method, and a program with a view to facilitating the mixing of sounds with respect to a free viewpoint.

BACKGROUND ART

Heretofore, the mixing of sounds has involved the use of sound volume and two-dimensional position information, among others. For example, PTL 1 describes techniques for detecting the positions of microphones and musical instruments arranged on the stage using a mesh-type sensor for example, the results of the position detection serving as a basis for displaying, on a control table screen, objects by which parameter values of the microphones and musical instruments can be changed. This process intuitively associates the objects with the microphones and musical instruments in controlling their parameters.

CITATION LIST

Patent Literature

[PTL 1]
Japanese Patent Laid-Open No. 2010-028620

SUMMARY

Technical Problem

Meanwhile, in the case where sounds are to be generated with respect to a three-dimensionally movable viewpoint, i.e., where sounds are to be generated as listened to from a free listening point, it is not easy for the existing sound mixing setup using two-dimensional position information to generate the sounds in a manner reflecting a three-dimensionally movable listening point.

In view of the above circumstances, the present technology aims to provide with an information processing apparatus, an information processing method, and a program for facilitating the mixing of sounds with respect to a free listening point.

Solution to Problem

According to a first aspect of the present technology, there is provided an information processing apparatus including a mixing process section configured to perform a mixing process on the basis of arrangement information regarding a sound source setting section to which a sound source is assigned, setting parameter information from the sound source setting section, and arrangement information regarding a listening setting section to which a listening point is assigned, and by use of data regarding the sound source.

According to the present technology, the sound source setting section and the listening setting section are physical devices placed on a placing table provided in real space. The sound source setting section or the listening setting section is configured to have a parameter setting section, a display section, and an arrangement relocation section for relocating on a placing surface of the placing table. Further, the sound source setting section or the listening setting section may be configured to be variable in shape and to generate arrangement information or setting parameter information in accordance with the shape. A reflecting member to which reflection characteristic is assigned may be provided and configured to be placeable on the placing table.

The mixing process section performs the mixing process on the basis of the arrangement information regarding the sound source setting section to which the sound source is assigned, the setting parameter information generated by use of the parameter setting section of the sound source setting section, and the arrangement information regarding the listening setting section to which the listening point is assigned and by use of the data regarding the sound source. Also, the mixing process section carries out the mixing process using the arrangement information regarding the reflecting member and the reflection characteristic assigned thereto.

The mixing process section transmits applicable parameter information used in the mixing process regarding the sound source to the sound source setting section corresponding to the sound source, causing the display section to display the applicable parameter information. The mixing process section arranges the sound source setting section and sets parameters for the sound source setting section on the basis of metadata associated with the sound source. Also, the mixing process section stores into an information storage section the arrangement information and the applicable parameter information used in the mixing process together with an elapsed time. When performing the mixing process using the information stored in the information storage section, the mixing process section transmits either to the sound source setting section or to the listening setting section a relocation signal for relocating the sound source setting section and the listening setting section in a manner reflecting the arrangement information acquired from the information storage section. This puts the sound source setting section or the listening setting section in the arrangement at the time of setting by the mixing process. Also, using the arrangement information and the applicable parameter information stored in the information storage section, the mixing process section generates arrangement information and applicable parameter information regarding a listening point about which the arrangement information and the applicable parameter information are not stored. When receiving an operation to change the arrangement of the sound source with respect to the listening point, the mixing process section performs the mixing process on the basis of the arrangement following the changing operation, and transmits either to the sound source setting section or to the listening setting section a relocation signal for relocating the sound source setting section and the listening setting section in a manner reflecting the arrangement following the changing operation. When a mixed sound generated by the mixing process fails to meet a predetermined admissibility condition, the mixing process section transmits a notification signal indicating the failure to meet the admissibility condition either to the sound source setting section or to the listening setting section.

The mixing process section includes an image generation section configured to discriminate a positional relationship of the sound source setting section with respect to the listening setting section on the basis of arrangement status of the sound source setting section and the listening setting section, the image generation section further displaying an image at the position, in a virtual space, of the sound source setting section relative to the listening setting section on the basis of the result of the discrimination, the image having a texture indicative of the sound source assigned to the sound source setting section. The image generation section thus generates an image as viewed from a viewpoint represented by the listening point, for example. Also, the image generation section overlays an image visualizing a sound output from the sound source onto a corresponding sound source position in the image having the texture indicative of the sound source. Further, the image generation section overlays an image visualizing a reflected sound of the sound output from the sound source onto a sound-reflecting position set by the mixing process in the image having the texture indicative of the sound source.

According to a second aspect of the present technology, there is provided an information processing method including: causing a mixing process section to acquire arrangement information and setting parameter information regarding a sound source setting section to which a sound source is assigned; causing the mixing process section to acquire arrangement information regarding a listening setting section to which a listening point is assigned; and causing the mixing process section to perform a mixing process on the basis of the acquired arrangement information and setting parameter information and, by use of data regarding the sound source.

According to a third aspect of the present technology, there is provided a program causing a computer to implement functions including: acquiring arrangement information and setting parameter information regarding a sound source setting section to which a sound source is assigned; acquiring arrangement information regarding a listening setting section to which a listening point is assigned; and performing a mixing process on the basis of the acquired arrangement information and setting parameter information, and by use of data regarding the sound source.

Incidentally, the program of the present technology may be offered in a computer-readable format to a general-purpose computer capable of executing diverse program codes, using storage media such as optical disks, magnetic disks or semiconductor memories, or via communication media such as networks. When provided with such a program in a computer-readable manner, the computer performs the processes defined by the program.

Advantageous Effects of Invention

According to the present technology, the mixing process section performs the mixing process on the basis of the arrangement information regarding the sound source setting section to which the sound source is assigned, the setting parameter information from the sound source setting section, and the arrangement information regarding the listening setting section to which the listening point is assigned, and by use of the data regarding the sound source. The mixing of sounds is thus performed easily with respect to a free listening point. Incidentally, the advantageous effects stated in this description are only examples and are not limitative of the present technology. There may be additional advantageous effects derived from this description.

DESCRIPTION OF EMBODIMENTS

The preferred embodiments for practicing the present technology are described below. The description is given under the following headings:

1. Configuration of the information processing apparatus
2. Operations of the information processing apparatus
2-1. Mixing setting operation
2-2. Mixed sound reproduction operation
2-3. Automatic arrangement operation for the sound source setting sections
3. Other configurations and operations of the information processing apparatus
4. Operation example of the information processing apparatus <1. Configuration of the Information Processing Apparatus>

Figure 1:
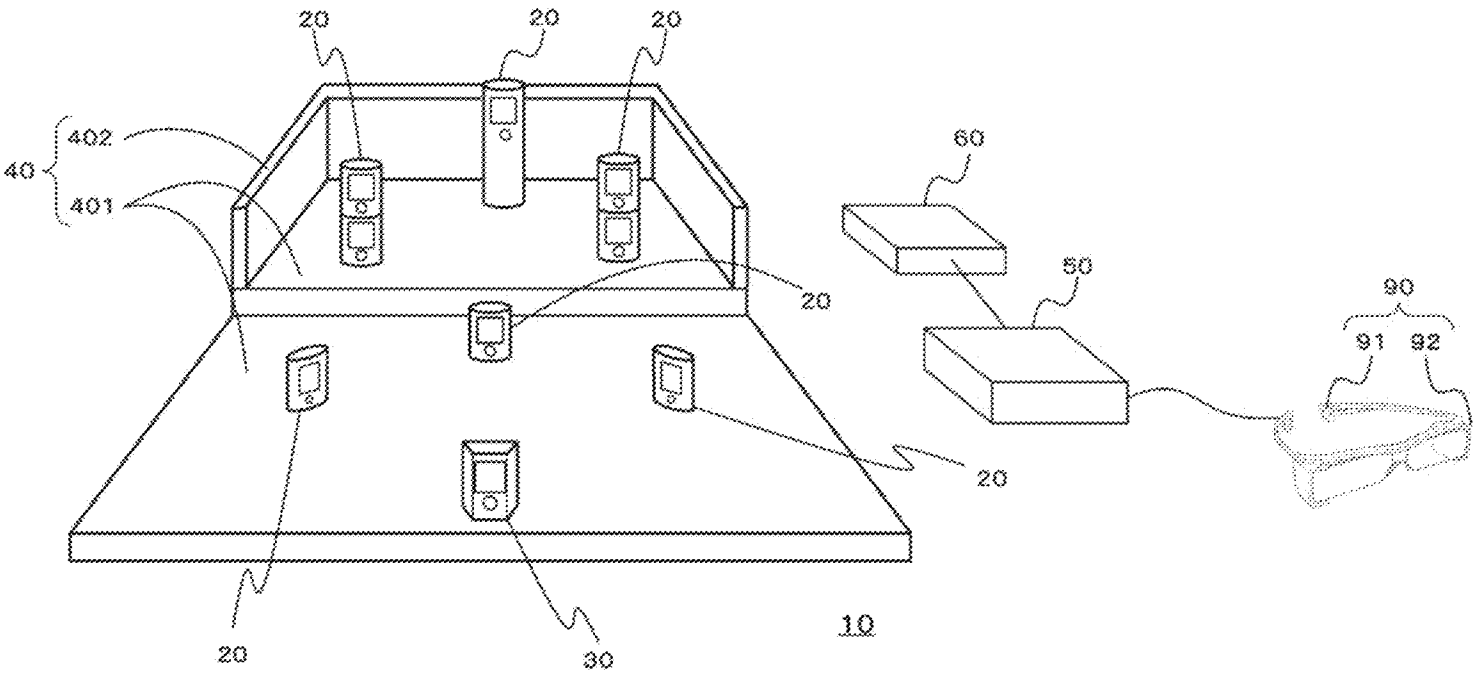
FIG. 1 is a schematic diagram depicting a typical external configuration of an information processing apparatus.
Figure 2:
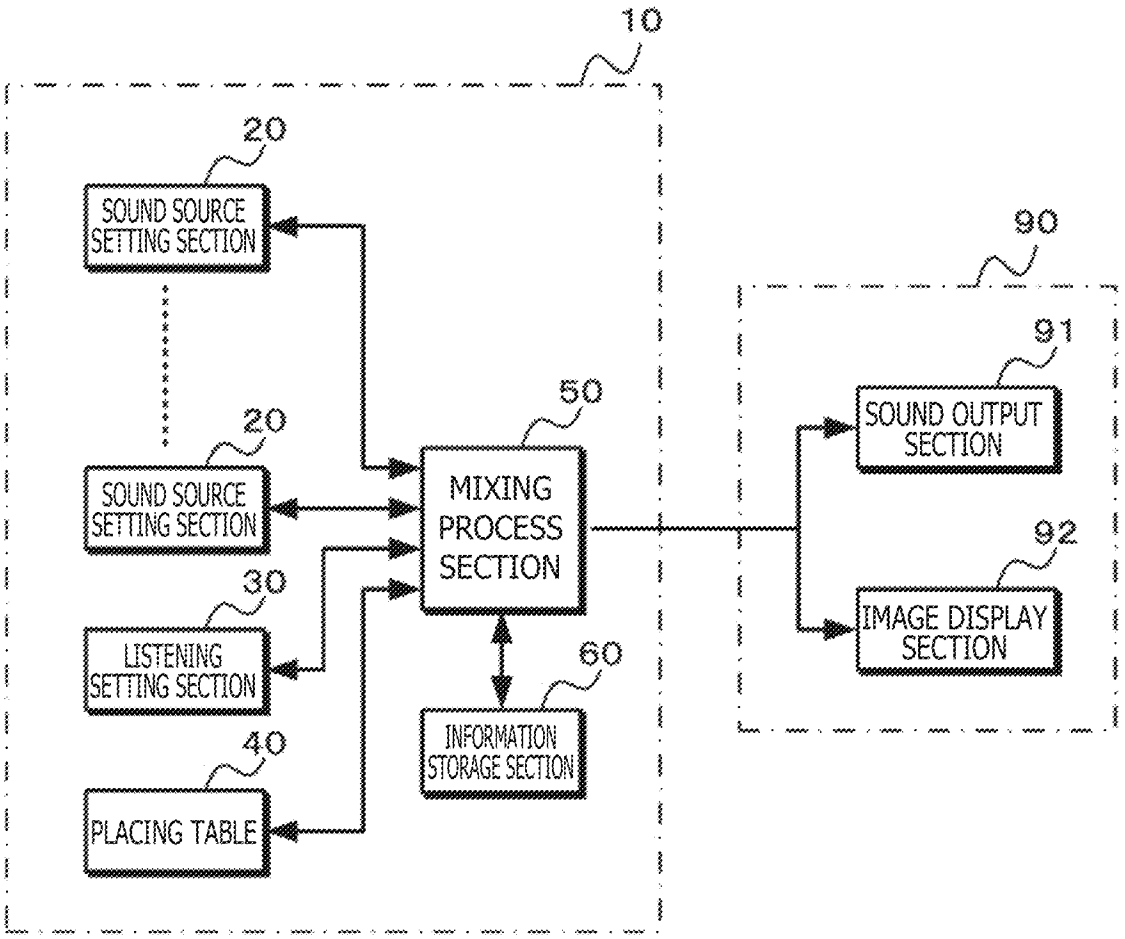
FIG. 2 is a schematic diagram depicting a typical functional configuration of the information processing apparatus.

FIG. 1 depicts a typical external configuration of an information processing apparatus 10, and FIG. 2 illustrates a typical functional configuration of the information processing apparatus 10. The information processing apparatus 10 includes sound source setting sections 20 as physical devices each corresponding to a sound source, a listening setting section 30 as a physical device corresponding to a listening point, a placing table 40 on which the sound source setting sections 20 and the listening setting section 30 are placed, a mixing process section 50, and an information storage section 60. The mixing process section 50 is connected with an output apparatus 90.

The sound source setting sections 20 each have functions to set a sound source position, a sound output direction, a sound source height, a sound volume, and sound processing (effects). A sound source setting section 20 may be configured for each sound source. Alternatively, one sound source setting section 20 may be configured to set or change mixing parameters for multiple sound sources.

The listening setting section 30 has functions to set a listening point position, a listening direction, a listening point height, a sound volume, and sound processing (effects) . Multiple listening setting sections 30 may be configured to arrange on the placing table 40 in a manner independent of one another. Alternatively, multiple listening setting sections 30 may be configured to arrange at the same position on the placing surface in a manner stacked one on top of the other.

The placing table 40 may have a flat placing surface 401 or a placing surface 401 with height differences. Alternatively, the placing table 40 may be configured to have a reflecting member 402 placed on the placing surface 401, the reflecting member 402 being assigned a sound-reflecting characteristic. The positions, directions, and heights of the sound source setting sections 20 and of the listening setting section 30 on the placing surface 401 of the placing table 40 represent relative positions and relative directions between the sound sources and the listening point. When the placing surface 401 is segmented into multiple regions thereby to indicate the regions where the sound source setting sections 20 and the listening setting section 30 are arranged, the data size of arrangement information indicative of the positions, directions, and heights of the sound source setting sections 20 and of the listening setting section 30 is lowered. In this manner, the position information is reduced in quantity. Incidentally, when the relocation of a viewpoint performed by an image display section 92, to be discussed later, is discretized, it is also possible to reduce the data quantity of the arrangement information regarding the sound source setting sections 20 and the listening setting section 30 in the case where the mixing process is changed depending on the viewpoint.

On the basis of arrangement information regarding the sound source setting sections 20 to which sound sources are assigned, setting parameter information from the sound source setting sections 20, and arrangement information regarding the listening setting section 30 to which the listening point is assigned, the mixing process section 50 performs the mixing process using the sound data regarding each sound source stored in the information storage section 60. Alternatively, the mixing process section 50 may perform the mixing process based on acoustic environment information from the placing table 40. By carrying out the mixing process, the mixing process section 50 generates sound output data representing the sounds listened to from the listening point indicated by the listening setting section 30. Also, the mixing process section 50 generates image output data with respect to the viewpoint represented by the listening point indicated by the listening setting section 30 using image information stored in the information storage section 60.

The information storage section 60 stores sound source data and metadata regarding the sound source data. The metadata represents information regarding the positions, directions, and heights of the sound sources and microphones used at the time of recording; changes over time in these positions, directions, and heights; recording levels; and sound effects set at the time of recording. In order to display free-viewpoint images, the information storage section 60 stores, as image information, three-dimensional model data constituted by meshes and textures generated by three-dimensional reconstruction, for example. Also, the information storage section 60 stores the arrangement information regarding the sound source setting sections 20 and the listening setting section 30, applicable parameter information used in the mixing process, and the acoustic environment information regarding the placing table 40.

The output apparatus 90 includes a sound output section (e.g., earphones) 91 and an image display section (e.g., head-mounted display) 92. The sound output section 91 outputs a mixed sound based on the sound output data generated by the mixing process section 50. The image display section 92 displays an image with respect to the viewpoint represented by the listening position for the mixed sound on the basis of the image output data generated by the mixing process section 50.

Figure 3:
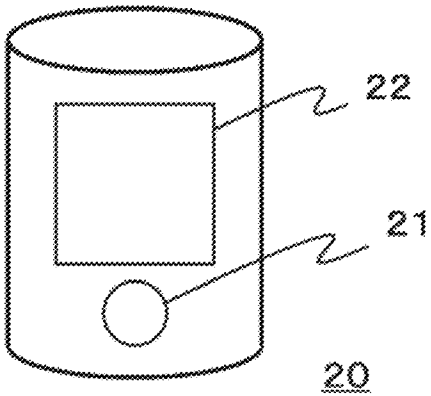
FIG. 3 is a schematic diagram depicting a typical configuration of a sound source setting section.
Figure 3:
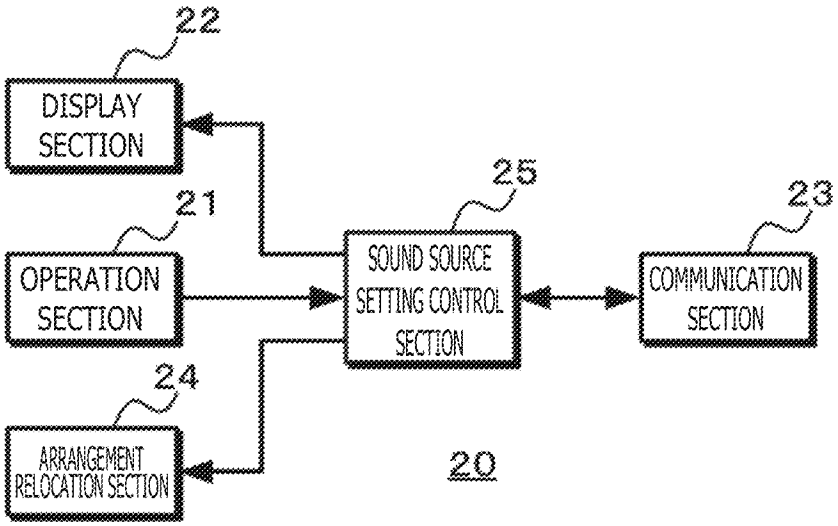

FIG. 3 depicts a typical configuration of the sound source setting section. Subfigure (a) in FIG. 3 illustrates an external appearance of the sound source setting section. Subfigure (b) in FIG. 3 indicates functional blocks of the sound source setting section.

The sound source setting section 20 includes an operation section 21, a display section 22, a communication section 23, an arrangement relocation section 24, and a sound source setting control section 25.

The operation section 21 receives a user's operations such as setting and changing of mixing parameters, and generates operation signals reflecting these operations. In the case where the operation section 21 includes a dial for example, the operation section 21 may generate the operation signals corresponding to the rotating action of the dial for setting or changing the sound volume or sound effects on the sound sources associated with the sound source setting sections 20.

The display section 22 displays mixing parameters, among others, used in the mixing process regarding the sound sources associated with the sound source setting sections 20 on the basis of the applicable parameter information received by the communication section 23 from the mixing process section 50.

The communication section 23 communicates with the mixing process section 50 and transmits thereto the setting parameter information and arrangement information generated by the sound source setting control section 25. The setting parameter information may be information indicative of the mixing parameters set by the user's operations. Alternatively, the setting parameter information may be operation signals regarding the setting or changing of the mixing parameters used in the mixing process. The arrangement information indicates the positions, directions, and heights of the sound sources. Also, the communication section 23 receives applicable parameter information and sound source relocation signals from the mixing process section 50, and outputs the applicable parameter information to the display section 22 and the sound source relocation signals to the sound source setting control section 25.

The arrangement relocation section 24 relocates the sound source setting sections 20 by traveling over the placing surface of the placing table 40 in accordance with drive signals from the sound source setting control section 25. Also, the arrangement relocation section 24 changes the shape of a sound source setting section 20, through elongation or contraction for example, on the basis of drive signals from the sound source setting control section 25. Alternatively, the sound source setting sections 20 may be relocated manually by the user exerting operating force.

The sound source setting control section 25 transmits the setting parameter information generated on the basis of the operation signal supplied from the operation section 21 to the mixing process section 50 via the communication section 23. Also, the sound source setting control section 25 generates the arrangement information indicative of the positions, directions, and heights of the sound sources on the basis of the positions of the sound source setting sections 20 detected on the placing surface of the placing table 40 using sensors. The sound source setting control section 25 transmits the arrangement information thus generated to the mixing process section 50 via the communication section 23. In the case where the shapes of the sound source setting sections 20 are allowed to be changed, the sound source setting control section 25 may generate the arrangement information reflecting the changed shape of a sound source setting section 20 being elongated for example, the generated arrangement information thereupon indicating that the corresponding sound source is at a high position. Also, the sound source setting control section 25 may generate setting parameter information otherwise reflecting the changed shape of a sound source setting section 20 being elongated for example, the generated setting parameter information thereupon causing the corresponding sound volume to be increased. Furthermore, the sound source setting control section 25 generates drive signals based on sound source relocation signals received via the communication section 23. The sound source setting control section 25 outputs the generated drive signals to the arrangement relocation section 24, thereby bringing the applicable sound source setting section 20 to the position, direction, and height on the placing surface of the placing table 40 as designated by the mixing process section 50. Alternatively, the arrangement information regarding the sound source setting sections 20 may be generated by the pacing table 40.

Figure 4:
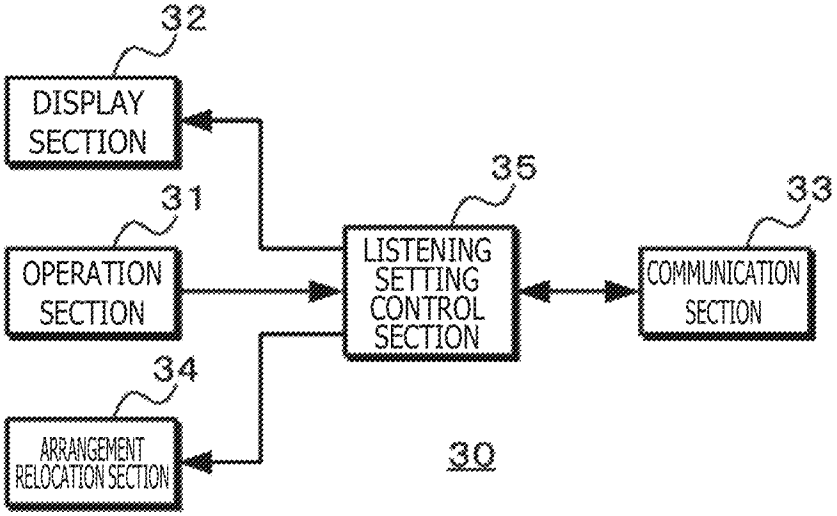
FIG. 4 is a schematic diagram depicting a typical configuration of a listening setting section.
Figure 4:
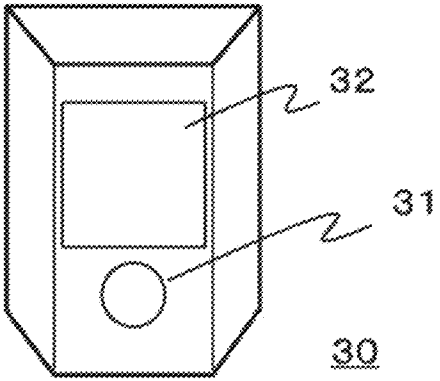

FIG. 4 depicts a typical configuration of the listening setting section. Subfigure (a) in FIG. 4 illustrates an external appearance of the listening setting section. Subfigure (b) in FIG. 4 indicates functional blocks of the listening setting section.

The listening setting section 30 is externally shaped to be easily distinguishable from the sound source setting sections 20. The listening setting section 30 includes an operation section 31, a display section 32, a communication section 33, an arrangement relocation section 34, and a listening setting control section 35. In the case where the position, direction, and height of the listening point are fixed beforehand, it may be configured the use of the arrangement relocation section 34 is optional.

The operation section 31 receives the user's operations such as setting and changing of listening parameters, and generates operation signals reflecting these operations. In the case where the operation section 31 includes a dial for example, the operation section 31 may generate the operation signals corresponding to the rotating action of the dial for setting or changing the sound volume or sound effects at the listening point associated with the listening setting section 30.

The display section 32 displays listening parameters, among others, used in the mixing process regarding the listening point associated with the listening setting section 30 on the basis of the applicable parameter information received by the communication section 33 from the mixing process section 50.

The communication section 33 communicates with the mixing process section 50 and transmits thereto the setting parameter information and arrangement information generated by the listening setting control section 35. The setting parameter information may be information indicative of the listening parameters set by the user's operations. Alternatively, the setting parameter information may be operation signals regarding the setting or changing of the listening parameters used in the mixing process. The arrangement information indicates the position and height of the listening point. Also, the communication section 33 receives the applicable parameter information and listening point relocation signals transmitted from the mixing process section 50, and outputs the applicable parameter information to the display section 32 and the listening point relocation signals to the listening setting control section 35.

The arrangement relocation section 34 relocates the listening setting section 30 by traveling over the placing surface of the placing table 40 in accordance with drive signals from the listening setting control section 35. Also, the arrangement relocation section 34 changes the shape of the listening setting section 30, through elongation or contraction for example, on the basis of drive signals from the listening setting control section 35. Alternatively, the listening setting sections 30 may be relocated manually by the user exerting operating force.

The listening setting control section 35 transmits the setting parameter information generated on the basis of the operation signal supplied from the operation section 31 to the mixing process section 50 via the communication section 33. Also, the listening setting control section 35 generates the arrangement information indicative of the position, direction, and height of the listening point on the basis of the position of the listening setting section 30 detected on the placing surface of the placing table 40 using sensors. The listening setting control section 35 transmits the arrangement information thus generated to the mixing process section 50 via the communication section 33. In the case where the shape of the listening setting sections 30 is allowed to be changed, the listening setting control section 35 may generate arrangement information reflecting the changed shape of the listening setting section 30 being elongated for example, the generated arrangement information thereupon indicating that the listening point is at a high position. Also, the listening setting control section 35 may generate setting parameter information otherwise reflecting the changed shape of the listening setting section 30 being elongated for example, the generated setting parameter information thereupon causing the sound volume to be increased. Furthermore, the listening setting control section 35 generates drive signals based on listening point relocation signals received via the communication section 33. The listening setting control section 35 outputs the generated drive signals to the arrangement relocation section 34, thereby bringing the listening setting section 30 to the position, direction, and height on the placing surface of the placing table 40 as designated by the mixing process section 50. Alternatively, the arrangement information regarding the listening setting sections 30 may be generated by the pacing table 40.

Figure 5:
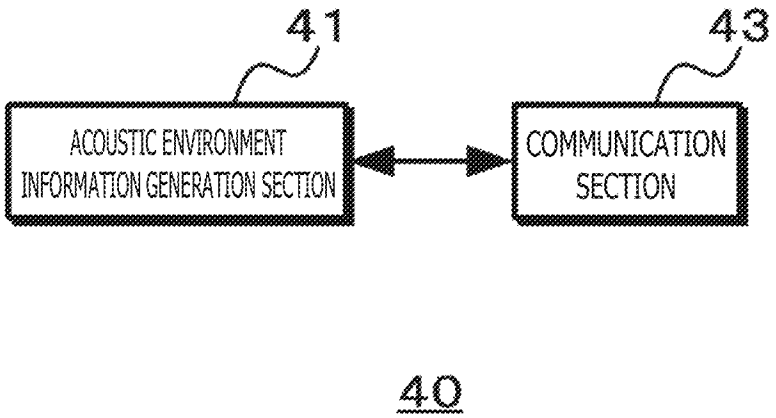
FIG. 5 is a schematic diagram depicting a typical functional configuration of a placing table.

FIG. 5 depicts a typical functional configuration of the placing table. The placing table 40 is configured to have the placing surface 401 adjusted in height or have the reflecting member 402 installed thereon. The placing table 40 includes an acoustic environment information generation section 41 and a communication section 43.

The acoustic environment information generation section 41 generates acoustic environment information indicative of the height of the placing surface 401 and the installation position and reflection characteristic of the reflecting member 402, for example. The acoustic environment information generation section 41 transmits the generated acoustic environment information to the communication section 43.

The communication section 43 communicates with the mixing process section 50 and transmits thereto the acoustic environment information generated by the acoustic environment information generation section 41. The acoustic environment information generation section 41 may, in place of the sound source setting sections 20 and the listening setting section 30, detect their positions and directions on the placing surface of the placing table 40 using sensors. The acoustic environment information generation section 41 then generates arrangement information indicative of the results of the detection and transmits the generated arrangement information to the mixing process section 50.

On the basis of the setting parameter information and arrangement information acquired from the sound source setting sections 20, the mixing process section 50 discriminates the state of sounds being output from the sound sources indicated by the sound source setting sections 20, i.e., the type of each sound, the direction in which each sound is output, and the height at which each sound is output. On the basis of the listening parameters and the arrangement information acquired from the listening setting sections 30, the mixing process section 50 also discriminates the state of the sounds being listened to from the listening point indicated by the listening setting section 30, i.e., the status of the listening parameters, the direction in which the sounds are listened to, and the height at which the sounds are listened to. Furthermore, in accordance with the acoustic environment information acquired from the placing table 40, the mixing process section 50 discriminates the reflecting state of the sounds output from the sound sources indicated by the sound source setting sections 20.

In accordance with the result of discrimination of the sounds output from the sound sources indicated by the sound source setting sections 20, the result of discrimination of the state of sounds being listened to from the listening point indicated by the listening setting section 30, and the result of discrimination of the sound reflecting state based on the acoustic environment information from the placing table 40, the mixing process section 50 generates sound signals representative of the sounds to be listened to from the listening point indicated by the listening setting section 30. The mixing process section 50 outputs the generated sound signals to the sound output section 91 of the output apparatus 90. Also, the mixing process section 50 generates the applicable parameter information indicative of the mixing parameters used in the mixing process regarding each sound source, and outputs the generated applicable parameter information to the sound source setting sections 20 corresponding to the sound sources. The parameters in the applicable parameter information may or may not coincide with the parameters in the setting parameter information. Depending on the parameters for other sound sources and on the mixing process involved, the parameters in the setting parameter information regarding each sound source may be changed and used as different parameters. Thus when the applicable parameter information is transmitted to the sound source setting sections 20, the sound source setting sections 20 can verify the mixing parameters that were used in the mixing process.

Also, on the basis of the arrangement information regarding the sound source setting sections 20 and the listening setting section 30, the mixing process section 50 generates a free-viewpoint image signal destined for the listening setting section 30 relative to the viewpoint represented by the listening point defined by the position and height of the listening setting section 30. The mixing process section 50 outputs the generated free-viewpoint image signal to the image display section 92 of the output apparatus 90.

Further, in the case where the image display section 92 notifies the mixing process section 50 that the viewpoint of the image presented to a viewer/listener has been relocated, the mixing process section 50 may generate a sound signal representative of the sound listened to by the viewer/listener following the viewpoint relocation, and output the generated sound signal to the sound output section 91. In this case, the mixing process section 50 generates a listening point relocation signal reflecting the viewpoint relocation, and outputs the generated listening point relocation signal to the listening setting section 30. Thus the mixing process section 50 causes the listening setting section 30 to relocate in keeping with the relocated viewpoint of the image presented to the viewer/listener.

Figure 6:
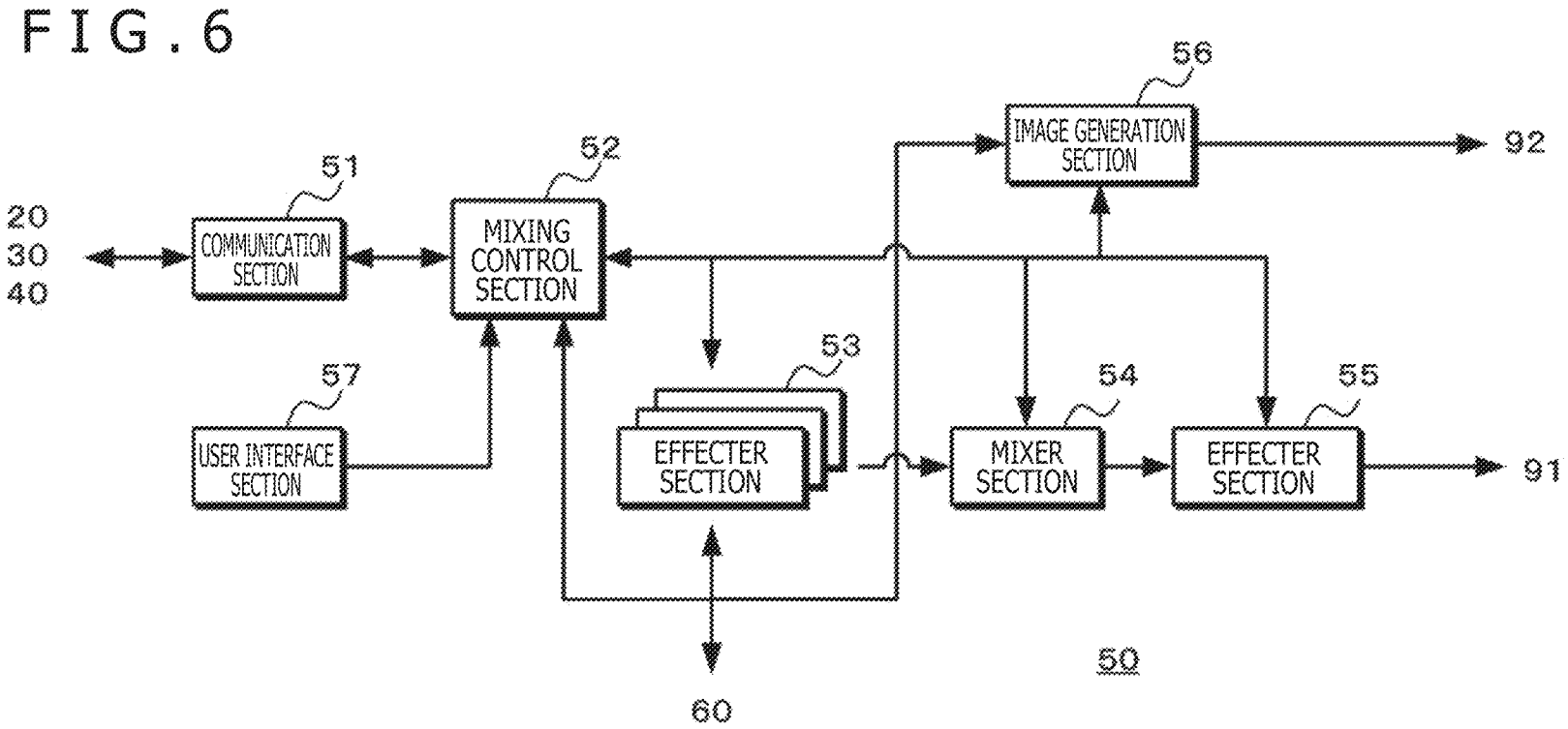
FIG. 6 is a schematic diagram depicting a typical functional configuration of a mixing process section.

FIG. 6 depicts a typical functional configuration of the mixing process section. The mixing process section 50 includes a communication section 51, a mixing control section 52, an effecter section 53, a mixer section 54, an effecter section 55, an image generation section 56, and a user interface (I/F) section 57.

The communication section 51 communicates with the sound source setting sections 20, the listening setting section 30, and the placing table 40 to acquire the setting parameter information, arrangement information, and acoustic environment information regarding the sound sources and the listening point. The communication section 51 outputs the acquired setting parameter information, arrangement information, and acoustic environment information to the mixing control section 52. Also, the communication section 51 transmits the sound source relocation signals and the applicable parameter information generated by the mixing control section 52 to the sound source setting sections 20. Furthermore, the communication section 51 transmits the listening point relocation signal and the applicable parameter information generated by the mixing control section 52 to the listening setting section 30.

The mixing control section 52 generates effecter setting information and mixer setting information based on the setting parameter information and arrangement information acquired from the sound source setting sections 20 and the listening setting section 30, and on the acoustic environment information acquired from the placing table 40. The mixing control section 52 outputs the effecter setting information to the effecter sections 53 and 55, and the mixer setting information to the mixer section 54. For example, the mixing control section 52 generates the effecter setting information based on the acoustic environment information and on the mixing parameters set or changed by each sound source setting section 20. The mixing control section 52 outputs the generated effecter setting information to the effecter section 53 that performs an effect process on the sound source data associated with the sound source setting sections 20. Also, the mixing control section 52 generates the mixer setting information based on the arrangement of the sound source setting sections 20 and of the listening setting section 30, and outputs the generated mixer setting information to the mixer section 54. Further, the mixing control section 52 generates the effecter setting information based on the listening parameters set or changed by the listening setting section 30, and outputs the generated effecter setting information to the effecter section 55. Also, the mixing control section 52 generates the applicable parameter information in accordance with the generated effecter setting information and mixer setting information, and outputs the generated applicable parameter information to the communication section 51. Furthermore, in the case where an image is to be displayed with respect to the viewpoint represented by the listening point, the mixing control section 52 outputs the arrangement information regarding the sound source setting sections 20 and the listening setting section 30 to the image generation section 56.

Upon discriminating that a mixing changing operation (i.e., an operation to change the arrangement or parameters of the source sources and listening point) has been performed on the basis of operation signals from the user interface section 57, the mixing control section 52 changes the effecter setting information and mixer setting information in accordance with the mixing changing operation. Also in keeping with the mixing changing operation, the mixing control section 52 generates a sound source relocation signal, a listening point relocation signal, and applicable parameter information. The mixing control section 52 outputs the generated sound source relocation signal, listening point relocation signal, and applicable parameter information to the communication section 51 to arrange the sound source setting sections 20 and the listening setting section 30 in a manner reflecting the changing operation.

The mixing control section 52 stores into the information storage section 60, along with an elapsed time, the arrangement information acquired from the sound source setting sections 20 and the listening setting section 30, the acoustic environment information acquired from the placing table 40, and the applicable parameter information used in the mixing process. When the arrangement information and the applicable parameter information are stored in this manner, the stored information may later be used chronologically to reproduce the mixing process and mixing setting operations. Incidentally, the information storage section 60 may also store the setting parameter information.

Furthermore, the mixing control section 52 may acquire metadata regarding the sound sources from the information storage section 60 to initialize the sound source setting sections 20 and the listening setting section 30. The mixing control section 52 generates the sound source relocation signal and the listening point relocation signal in accordance with the positions, directions, and heights of the sound sources and the microphones. The mixing control section 52 also generates the applicable parameter information on the basis of information such as recording levels and sound effects set at the time of recording. By transmitting the generated sound source relocation signal, listening point relocation signal, and parameter signal via the communication section 51, the mixing control section 52 can arrange the sound source setting sections 20 and the listening setting section 30 in a manner corresponding to the positions of the sound sources and the microphones. The sound source setting sections 20 and the listening setting section 30 may display recording levels and effect settings at the timing of recording.

The effecter section 53 is provided for each sound source, for example. On the basis of the effecter setting information supplied from the mixing control section 52, the effecter section 53 performs the effect process (e.g., application of delays or reverb and equalizing of frequency characteristics during music production) on the corresponding sound source data. The effecter section 53 outputs the sound source data having undergone the effect process to the mixer section 54.

The mixer section 54 mixes the sound source data following the effect process on the basis of the mixer setting information supplied from the mixing control section 52. The mixer section 54 generates sound data by adjusting, for enhancement purposes, the levels of the sound source data having undergone the effect process using the gain for each sound source as designated by the mixer setting information, for example. The mixer section 54 outputs the generated sound data to the effecter section 55.

On the basis of the effecter setting information supplied from the mixing control section 52, the effecter section 55 performs the effect process (e.g., application of delays or reverb and equalizing of frequency characteristics at the listening point) on the sound data. The effecter section 55 outputs the sound data having undergone the effect process as sound output data to the sound output section 91 of the output apparatus 90, for example.

On the basis of arrangement status of the sound source setting sections 20 and of the listening setting section 30, the image generation section 56 discriminates positional relationship of the sound source setting sections 20 relative to the listening setting section 30. In accordance with the result of the discrimination, the image generation section 56 generates an image with textures indicative of the sound sources assigned to the sound source setting sections 20 positioned in a virtual space with respect to the listening setting section 30. The image generation section 56 acquires image information such as three-dimensional model data from the information storage section 60. Next, the image generation section 56 discriminates the positional relationship of the sound source setting sections 20 relative to the listening setting section 30, i.e., positional relationship of the sound sources relative to the listening point, based on the arrangement information supplied from the mixing control section 52. Further, the image generation section 56 generates the image output data relative to the viewpoint by attaching textures associated with the sound sources to the sound source positions, the attached textures constituting an image viewed from the listening point representing the viewpoint. The image generation section 56 outputs the generated image output data to the image display section 92 of the output apparatus 90 for example. Also, the image generation section 56 may visually display in-space sounds in a virtual space. Furthermore, the image generation section 56 may display the intensity of reflected sounds in the form of wall brightness or textures.

The user interface section 57 generates operation signals reflecting the settings of operation and selecting operations to be performed by the mixing process section 50. The user interface section 57 outputs the generated operation signals to the mixing control section 52. On the basis of the operation signals, the mixing control section 52 controls the operations of the components involved in such a manner that the mixing process section 50 will carry out the operations desired by the user.

<2. Operations of the Information Processing Apparatus>

2-1. Mixing setting operation

Figure 7:
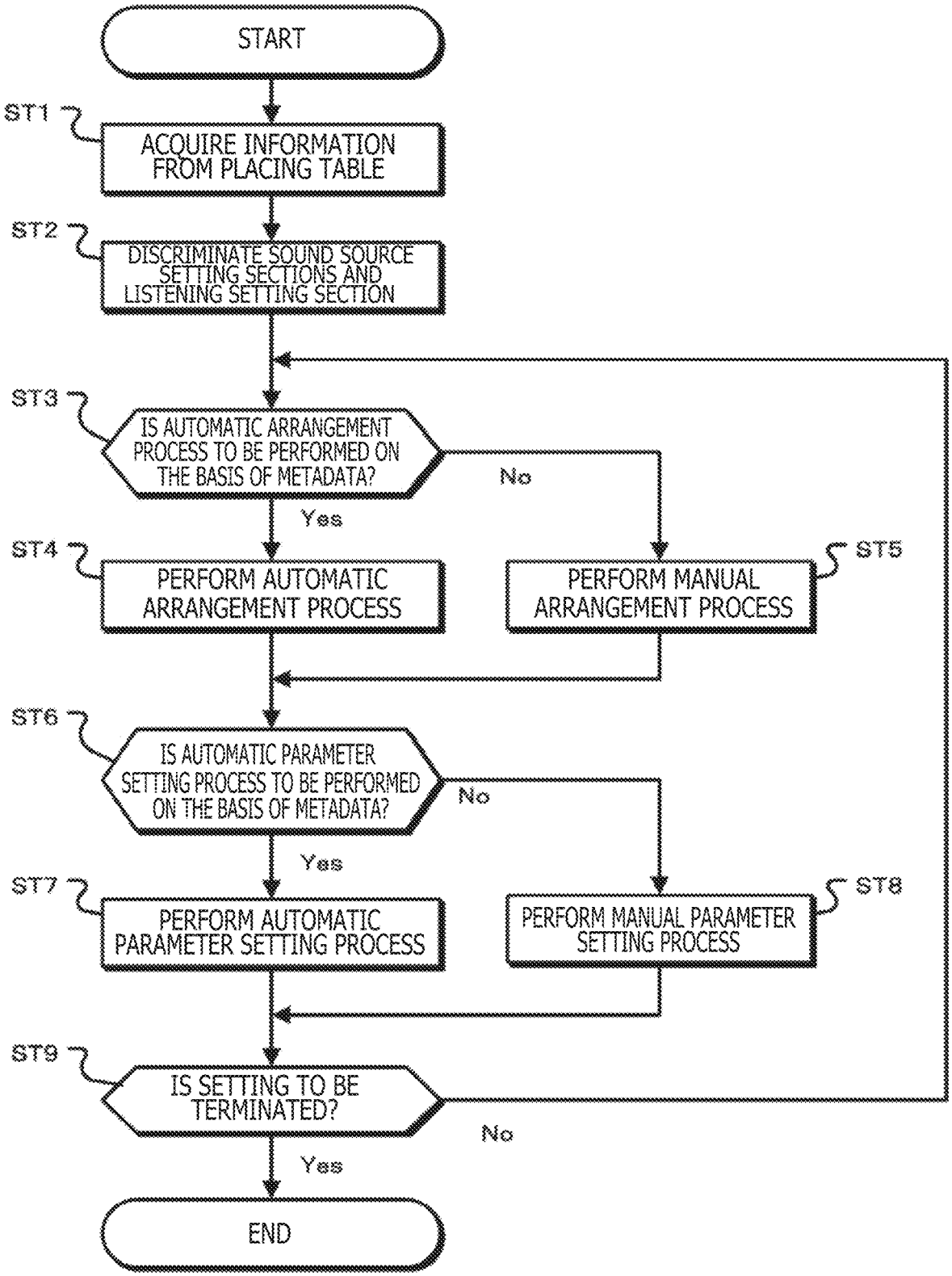
FIG. 7 is a flowchart depicting a mixing setting process.

The mixing setting operation performed by the information processing apparatus is explained below. FIG. 7 is a flowchart depicting a mixing setting process. In step ST1, the mixing process section acquires information from the placing table. Through communication with the placing table 40, the mixing process section 50 acquires placing table information such as the size and shape of the placing surface of the placing table 40 as well as the acoustic environment information indicative of wall installation status, for example. The mixing process section 50 then goes to step ST2.

In step ST2, the mixing process section discriminates the sound source setting sections and the listening setting section. The mixing process section 50 communicates with the sound source setting sections 20 and the listening setting section 30 or with the placing table 40. In making the communication, the mixing process section 50 discriminates that the sound source setting sections 20 corresponding to the sound sources and the listening setting section 30 are arranged on the placing surface of the placing table 40. The mixing process section 50 then goes to step ST3.

In step ST3, the mixing process section 50 discriminates whether an automatic arrangement process is to be carried out on the basis of the metadata. In the case where an operation mode is selected in which the sound source setting sections 20 and the listening setting section 30 are to be automatically arranged, the mixing process section 50 goes to step ST4. Where an operation mode is selected in which the sound source setting sections 20 and the listening setting section 30 are to be manually arranged, the mixing process section 50 goes to step ST5.

In step ST4, the mixing process section performs the automatic arrangement process. The mixing process section 50 discriminates the arrangement of the sound source setting sections 20 and the listening setting section 30 based on the metadata and, on the basis of the result of the discrimination, generates a sound source relocation signal for each of the sound sources. The mixing process section 50 transmits the sound source relocation signals to the corresponding sound source setting sections 20 to change their positions and directions in accordance with the metadata. Thus on the placing surface of the placing table 40, the sound source setting sections 20 corresponding to the sound sources are arranged in a manner reflecting the positions and directions of the sound sources associated with the metadata. The mixing process section 50 then goes to step ST6.

In step ST5, the mixing process section performs a manual arrangement process. The mixing process section 50 communicates with the sound source setting sections 20 and the listening setting section 30 or with the placing table 40. In making the communication, the mixing process section 50 discriminates the positions and the directions in which the sound source setting sections 20 corresponding to the sound sources on the placing surface of the placing table 40 and the listening setting section 30 are arranged. The mixing process section 50 then goes to step ST6.

In step ST6, the mixing process section discriminates whether an automatic parameter setting process is to be performed on the basis of the metadata. In the case where an operation mode is selected in which the mixing parameters and listening parameters are to be automatically set, the mixing process section 50 goes to step ST7. Where an operation mode is selected in which the mixing parameters and listening parameters are to be manually set, the mixing process section 50 goes to step ST8.

In step ST7, the mixing process section performs the automatic parameter setting process. The mixing process section 50 sets the parameters for the sound source setting sections 20 and for the listening setting section 30 based on the metadata thereby to set the parameters to be used in the mixing process regarding each of the sound sources. The mixing process section 50 also generates, for each sound source, the applicable parameter information indicative of the parameters for use in the mixing process. The mixing process section 50 transmits the applicable parameter information to the corresponding sound source setting section 20. This causes the display section 22 of the sound source setting section 20 to display the mixing parameters to be used in the mixing process. Thus the mixing parameters based on the metadata are displayed on the display sections 22 of the sound source setting sections 20 arranged on the placing surface of the placing table 40. Also, the mixing process section 50 transmits the applicable parameter information corresponding to the listening point on the basis of the metadata to the listening setting section 30, causing the display section 32 of the listening setting section 30 to display the parameters. Thus the listening parameters based on the metadata are displayed on the display section 32 of the listening setting section 30 arranged on the placing surface of the placing table 40. After causing the parameters based on the metadata to be displayed, the mixing process section 50 goes to step ST9.

In step ST8, the mixing process section performs a manual parameter setting process. The mixing process section 50 communicates with each of the sound source setting sections 20 to acquire the mixing parameters having been set or changed thereby. The mixing process section 50 also communicates with the listening setting section 30 to acquire the listening parameters set or changed thereby. The parameters set or changed by the sound source setting sections 20 and by the listening setting section 30 are displayed on their display sections. In this manner, the mixing process section 50 acquires the parameters from the sound source setting sections 20 and from the listening setting section 30, before going to step ST9.

In step ST9, the mixing process section discriminates whether the setting is to be terminated. In the case where the mixing process section 50 does not discriminate the termination of the setting, the mixing process section 50 returns to step ST3. Where the end of the setting is discriminated, e.g., where the user has performed a setting termination operation or where the metadata has come to an end, the mixing process section 50 performs the mixing setting process.

When the above processing is performed, with the operation mode selected for manual arrangement or for manual setting, the sound source setting sections 20 are manually operated to change their positions or their mixing parameters. In this manner, the positions and mixing parameters of the sound sources are set as desired at the time of generating the mixed sound. When the processing ranging from step ST3 to step ST9 is repeated, the positions and mixing parameters of the sound sources can be changed over time. Furthermore, in the case where the operation mode is selected for automatic arrangement or for automatic setting, the positions and directions of the sound source setting sections 20 and of the listening setting section 30 are automatically relocated in accordance with the metadata. This permits reproduction of the arrangement and of the parameters of the sound sources at the time the mixed sound associated with the metadata is generated.

In the case where it is desired to change simultaneously the mixing parameters of multiple sound source setting sections 20, a time range in which the mixing parameters are to change simultaneously is repeated, for example. In repeating the time range, the sound source setting sections 20 for which the mixing parameters are to be changed need only be switched one after another.

The above processing assumes that the mixing parameters are set for each of the sound source setting sections 20. However, there may well be cases where some sound source setting sections 20 have no mixing parameters set therefor. Thus where there is a sound source setting section 20 having no mixing parameter set therefor, the mixing process section may carry out an interpolation process on that sound source setting section 20 to set its mixing parameters.

Figure 8:
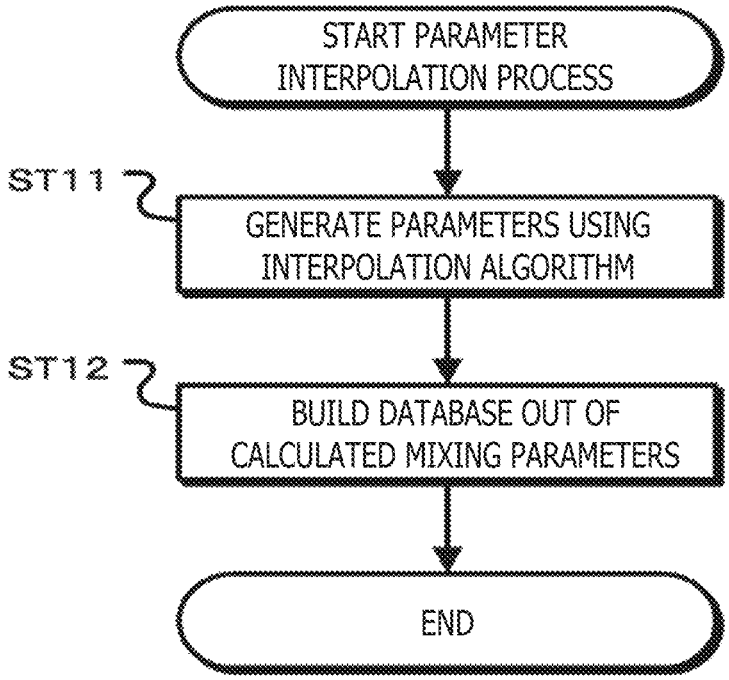
FIG. 8 is a flowchart depicting a mixing parameter interpolation process.

FIG. 8 is a flowchart depicting a mixing parameter interpolation process. In step ST11, the mixing process section generates parameters using an interpolation algorithm. The mixing process section 50 calculates the mixing parameters for a sound source setting section with no mixing parameters set therefor from the mixing parameters set for the other sound source setting sections on the basis of a predetermined algorithm. For example, the mixing process section 50 may calculate the sound volume for a sound source setting section with no mixing parameters set therefor from the sound volumes set for the other sound source setting sections in such a manner that the sound volume at the listening point is suitably determined on the basis of its positional relationship to the sound source setting sections. As another example, the mixing process section 50 may calculate the delay value for a sound source setting section with no mixing parameters set therefor from the delay values set for the other sound source setting sections in accordance with the positional relationship among the sound source setting sections. As a further example, the mixing process section 50 may calculate the reverb characteristic for a sound source setting section with no mixing parameters set therefor from the reverb characteristics set for the other sound source setting sections in accordance with the positional relationship among the walls and the sound source setting sections arranged on the placing table 40 on the one hand and the listening point on the other hand. After calculating the mixing parameters for the sound source setting section with no mixing parameters set therefor, the mixing process section 50 goes to step ST12.

In step ST12, the mixing process section builds a database out of the calculated mixing parameters. The mixing process section 50 associates the calculated mixing parameters with the corresponding sound source setting section and, together with the mixing parameters for the other sound source setting sections, and builds a database out of the calculated mixing parameters. The mixing process section 50 stores the database into the information storage section 60, for example. The mixing process section 50 may also calculate the mixing parameters for the sound source setting section with no mixing parameters set therefor from the mixing parameters for the other sound source setting sections using a stored interpolation processing algorithm.

With the above processing carried out, even if there exists a sound source setting section 20 with no mixing parameters set therefor, it is possible to perform a mixing-parameter-based effect process on the sound source data regarding the sound source associated with that sound source setting section 20 devoid of mixing parameters. Furthermore, with no sound source setting section 20 directly operated, the mixing parameters for a given sound source setting section 20 may be changed in accordance with the mixing parameters set for the other sound source setting sections 20.

In cases where the number of sound source is very large, as in the case of an orchestra, preparing a sound source setting section 20 for every sound source would make the mixing setting more complicated than is necessary. In such a case, one sound source setting section may be arranged to represent multiple sound sources in the mixing setting. The mixing parameters for sound sources other than those represented by the sound source setting sections may be automatically generated from the mixing parameters for the representative sound source setting sections. For example, there may be provided a sound source setting section representing the group of violins and a sound source setting section representing the group of flutes. The mixing parameters for the individual violins and flutes may then be automatically generated. In the automatic generation, the mixing parameters for a given position are generated with reference to the arrangement and the acoustic environment information regarding the sound source setting sections 20 and the listening setting section 30 as well as the setting parameter information regarding the sound source setting sections 20 for which the mixing parameters have been manually set.

Incidentally, at the time of mixing parameter interpolation processing, the mixing parameters may be interpolated not only for a sound source setting section with no mixing parameters set therefor but also for any desired listening point.

<2-2. Mixed Sound Reproduction Operation>

Figure 9:
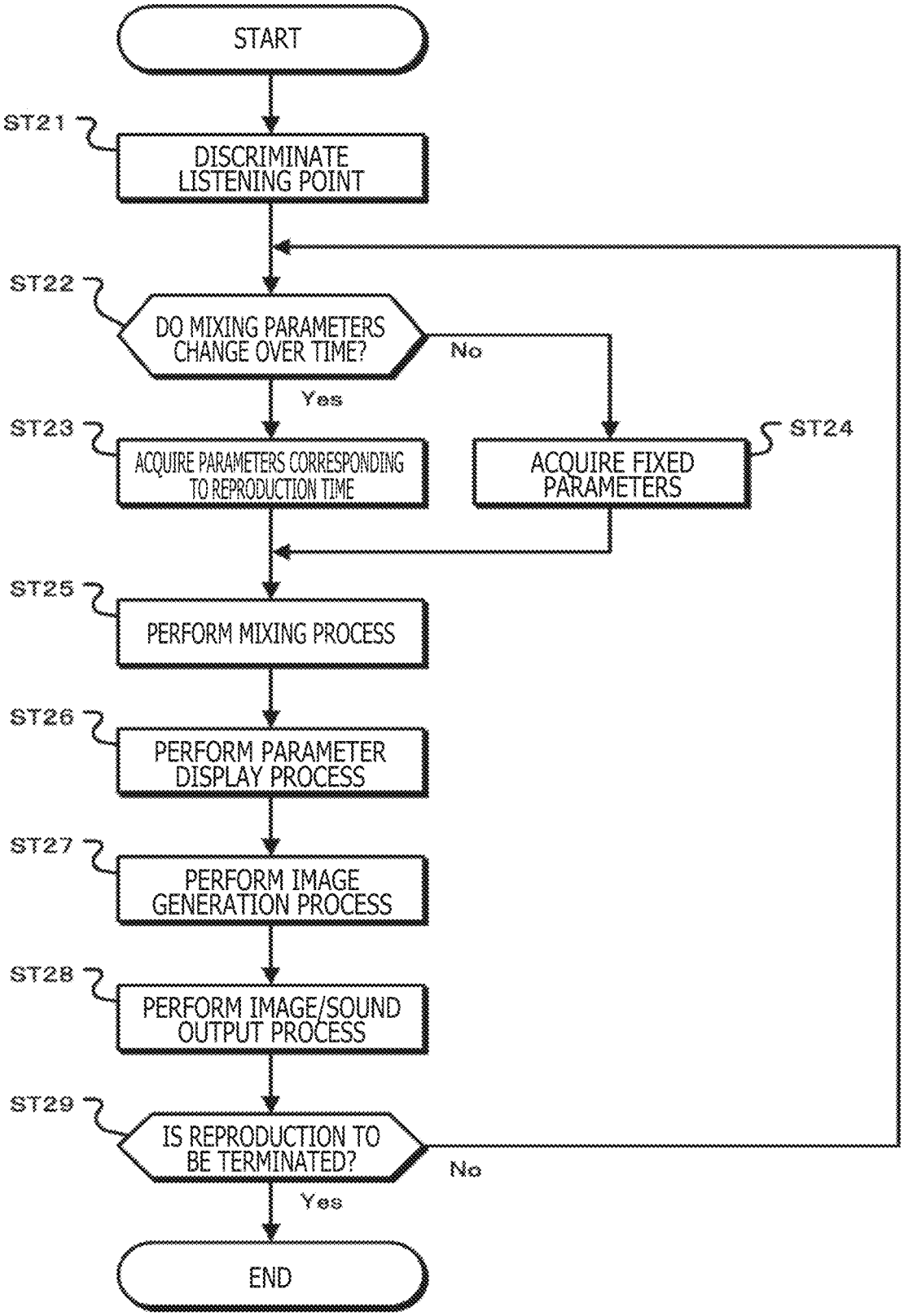
FIG. 9 is a flowchart depicting a mixed sound reproduction operation.

A mixed sound reproduction operation performed by the information processing apparatus is explained below. FIG. 9 is a flowchart depicting the mixed sound reproduction operation. In step ST21, the mixing process section discriminates the listening point. The mixing process section 50 communicates with the listening setting section 30 or with the placing table 40 to discriminate the arrangement of the listening setting section 30 on the placing surface of the placing table 40. The mixing process section 50 regards the discriminated position and direction as representing the listening point, before going to step ST22.

In step ST22, the mixing process section discriminates whether the mixing parameters change over time. In the case where the mixing parameters change over time, the mixing process section 50 goes to step ST23. Where the mixing parameters do not change over time, the mixing process section 50 goes to step ST24.

In step ST23, the mixing process section acquires the parameters corresponding to a reproduction time. The mixing process section 50 acquires the mixing parameters corresponding to the reproduction time from the mixing parameters stored in the information storage section 60. The mixing process section 50 then goes to step ST25.

In step ST24, the mixing process section acquires fixed parameters. The mixing process section 50 acquires the fixed parameters stored in the information storage section 60, before going to step ST25. In the case where the fixed mixing parameters have already been acquired, step ST24 may be skipped.

In step ST25, the mixing process section performs the mixing process. The mixing process section 50 generates the effecter setting information and the mixer setting information based on the mixing parameters so as to perform the effect process and the mixing process using the sound source data corresponding to the sound source setting sections 20. Through the processing, the mixing process section 50 generates a sound output signal, before going to step ST26.

In step ST26, the mixing process section performs a parameter display process. The mixing process section 50 generates the applicable parameter information indicative of the parameters used in conjunction with the reproduction time. The mixing process section 50 transmits the generated applicable parameter information to the sound source setting sections 20 and to the listening setting section 30, causing the sound source setting sections 20 and the listening setting section 30 to display the parameters. The mixing process section 50 then goes to step ST27.

In step ST27, the mixing process section performs an image generation process. The mixing process section 50 generates an image output signal corresponding to the reproduction time and to the mixing parameters, with the listening point regarded as the viewpoint. The mixing process section 50 then goes to step ST28.

In step ST28, the mixing process section performs an image/sound output process. The mixing process section 50 outputs the sound output signal generated in step ST25 and the image output signal generated in step ST27 to the output apparatus 90. The mixing process section 50 then goes to step ST29.

In step ST29, the mixing process section discriminates whether reproduction is to be terminated. In the case where a reproduction termination operation has yet to be performed, the mixing process section 50 returns to step ST22. Where the reproduction termination operation is performed or where the sound source data or the image information has come to an end, the mixing process section 50 terminates the mixed sound reproduction process.

The above processing, when carried out, permits sound output at a free listening point. If the mixing process is performed with the listening point set to correspond to the viewpoint, the sounds can be output in a manner associated with a free-viewpoint image.

<2-3. Automatic Arrangement Operation for the Sound Source Setting Sections>

Figure 10:
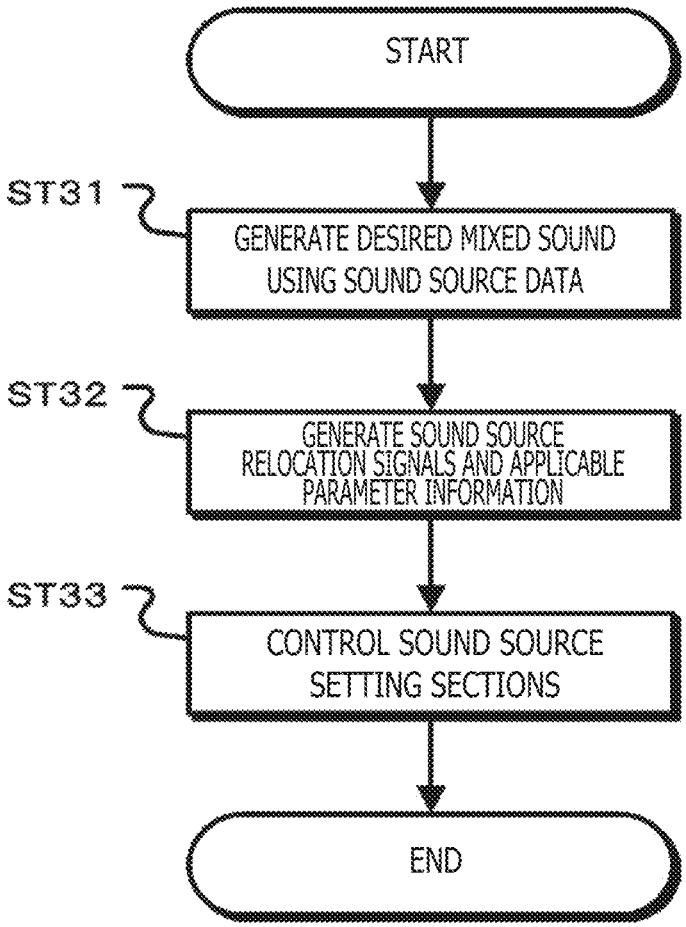
FIG. 10 is a flowchart depicting an automatic arrangement operation.

Explained below is an automatic arrangement operation to automatically arrange the sound source setting sections on the basis of the mixing parameters. FIG. 10 is a flowchart depicting the automatic arrangement operation. In step ST31, the mixing process section generates a desired mixed sound using the sound source data. The mixing process section 50 generates effect setting information and mixer setting information based on the user's operations performed on the user interface section 57. Further, the mixing process section 50 generates the desired mixed sound by performing the mixing process on the basis of the generated effect setting information and mixer setting information. For example, the user performs operations to arrange the sound sources and adjust sound effects so as to acquire a desired sound image for each of the sound sources. In accordance with the user's operations, the mixing process section 50 generates sound source arrangement information and effect setting information. The user also performs operations to adjust and combine the sound volumes of the individual sound sources in order to obtain the desired mixed sound. The mixing process section 50 generates the mixer setting information based on the user's operations. In accordance with the generated effect setting information and mixer setting information, the mixing process section 50 performs the mixing process to generate the desired mixed sound. The mixing process section 50 then goes to step ST32. Alternatively, the desired mixed sound may be generated using a method other than the above-described method.

In step ST32, the mixing process section generates sound source relocation signals and applicable parameter information. On the basis of the sound source arrangement information at the time of generation of the desired mixed sound in step ST31, the mixing process section 50 generates the sound source relocation signals for causing the sound source setting sections 20 associated with the sound sources to relocate in a manner reflecting the arrangement of the sound sources. Also, on the basis of the effect setting information and the mixer setting information at the time of generation of the desired mixed sound in step ST31, the mixing process section 50 generates the applicable parameter information for each of the sound sources. In the case where the sound source arrangement information, effect setting information, and mixer setting information are not generated at the time of generation of the desired mixed sound, the mixing process section 50 performs audio analysis or other appropriate analysis of the desired mixed sound so as to estimate one or multiple sets of sound source arrangements, effect settings, and mixer settings. Further, the mixing process section 50 generates the sound source relocation signals and the applicable parameter information on the basis of the result of the estimation. The mixing process section 50 thus generates the sound source relocation signal and the applicable parameter information for each of the sound sources, before going to step ST33.

In step ST33, the mixing process section controls the sound source setting sections. The mixing process section 50 transmits the sound source relocation signal generated for each of the sound sources to the sound source setting section 20 associated with each sound source, thereby causing the sound source setting sections 20 to relocate in a manner reflecting the arrangement of the sound sources at the time of generation of the desired mixed sound. Also, the mixing process section 50 transmits the applicable parameter information generated for each of the sound sources to the sound source setting sections 20 associated with the sound sources. The mixing process section 50 thus causes the display section 22 of each sound source setting section 20 to display the mixing parameters used in the mixing process in accordance with the transmitted applicable parameter information. In this manner, the mixing process section 50 controls the arrangement and displays of the sound source setting sections 20.

In the case where the mixing process section 50 is controlled in operation to generate the desired mixed sound, carrying out the above processing makes it possible for the sound source setting sections 20 on the placing surface of the placing table 40 to visually recognize the sound source arrangement that provides the desired mixed sound.

Upon completion of step ST33, the mixing process section 50 may acquire the arrangement and the mixing parameters of each of the sound source setting sections 20 so as to generate the mixed sound based on the acquired information. This enables verification of whether the sound source setting sections 20 are arranged and have the mixing parameters set therefor in a manner providing the desired mixed sound. In the case where the mixed sound generated on the basis of the acquired information differs from the desired mixed sound, the arrangement and the mixing parameters of the sound source setting sections 20 may be adjusted manually or automatically to generate the desired mixed sound. Explained above with reference to FIG. 10 was the case in which the sound source setting sections 20 are automatically arranged. Alternatively, the listening setting section 30 may be automatically relocated in accordance with the viewpoint being relocated in a free-viewpoint image.

When the information processing apparatus of the present technology is used as described above, the state of sound mixing at the free listening point is recognized in a three-dimensional, intuitive manner. It is also possible to easily verify the sounds at the free listening point. Furthermore, because the sounds at the free listening point are verifiable, it is possible to identify, for example, a listening point at which the sound volume is excessive, a listening point at which the sound balance is not as desired, or a listening point at which a sound not intended by a content provider is being heard. When there exists the listening point at which the sound not intended by the content provider is heard, it is possible to suppress the unintended sound or replace it with a predetermined sound at the position of that listening point. In the case where the mixed sound generated by the mixing process fails to meet predetermined admissibility conditions, e.g., where the sound volume exceeds an acceptable level or where the sound balance deteriorates beyond an acceptable level, a notification signal indicating the failure to meet the admissibility conditions may be transmitted to the sound source setting sections or to the listening setting section.

<3. Other Configurations and Operations of the Information Processing Apparatus>

Explained above was the case where the information processing apparatus uses the listening setting section in carrying out the mixing process. Alternatively, the listening setting section may not be used. For example, the listening point may be displayed in a virtual-space image appearing on the image display section 92. With the listening point allowed to move freely in the virtual space, the mixing parameters may be set on the basis of the listening point position in the virtual space, and the mixed sound may be generated accordingly.

The mixing parameters need not be input solely from the operation sections 21 of the sound source setting sections 20. Alternatively, the mixing parameters may be input from external equipment such as a mobile terminal apparatus. Further, an attachment may be prepared for each type of sound effects. When the attachment is fixed to the sound source setting section 20, the mixing parameters of the effect process corresponding to the fixed attachment may be set accordingly.

<4. Operation Examples of the Information Processing Apparatus>

Figure 11:
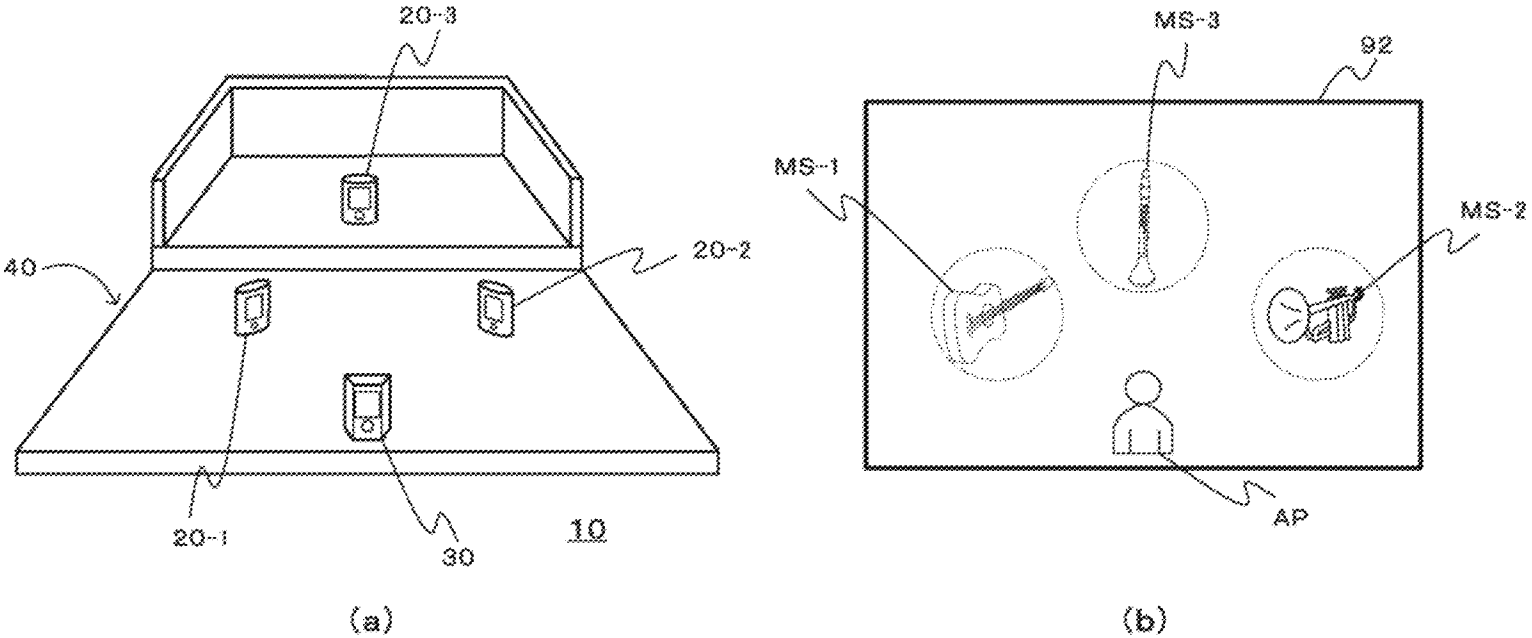
FIG. 11 is a schematic diagram depicting a typical operation of the information processing apparatus.

An operation example of the information processing apparatus is explained below. FIG. 11 depicts an operation example of the information processing apparatus. Subfigure (a) in FIG. 11 illustrates the arrangement of the sound source setting sections and the listening setting section. Subfigure (b) in FIG. 11 indicates a display example of the image display section. It is assumed, for example, that the sound source corresponding to a sound source setting section 20-1 is the guitar, that the sound source corresponding to a sound source setting section 20-2 is the trumpet, and that the sound source corresponding to a sound source setting section 20-3 is the clarinet.

Figure 12:
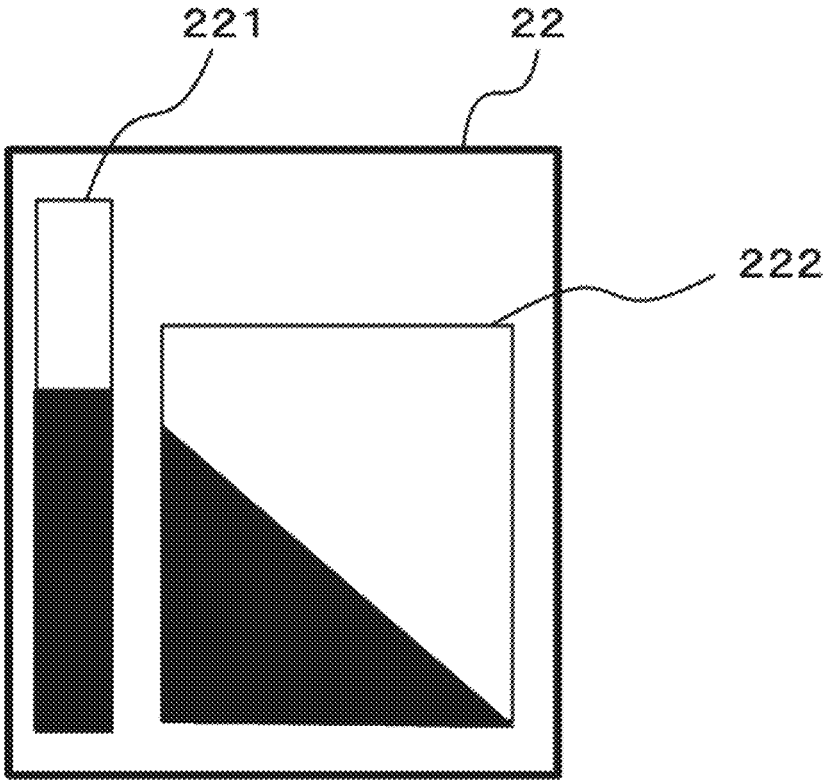
FIG. 12 is a schematic diagram depicting a display example on a display section of the sound source setting section.

The mixing process section 50 generates a mixed sound based on the arrangement of the sound source setting sections 20-1, 20-2 and 20-3 and of the listening setting section 30, on mixing parameters, and on listening parameters. The mixing process section 50 also generates applicable parameter information corresponding to the generated mixed sound. FIG. 12 depicts a display example on the display section of the sound source setting section. For example, the display section 22 of the sound source setting section 20-1 gives a guitar sound volume display 221 and a guitar sound parameter display 222 (e.g., a display of reverb characteristics in a coordinate system where the horizontal axis stands for time and the vertical axis for the signal level) based on the applicable parameter information. Also, the display sections 22 of the sound source setting sections 20-2 and 20-3 and the display section 32 of the listening setting section 30 each give a volume display and a parameter display in like manner. This makes it possible to verify, with respect to the generated mixed sound, the sound volume setting state and the parameter setting state at each of the sound sources and at the listening point. In the case where the sound volume for a given sound source setting section is set to zero, the texture of the sound source corresponding to that sound source setting section is arranged not to be displayed because there is no need to use the sound source data. In this manner, the texture of the sound source not used in the mixing process is not displayed on the screen.

The mixing process section 50 acquires from the information storage section 60 the three-dimensional model data corresponding to the sound source setting sections 20-1, 20-2 and 20-3 for example and, on the basis of the arrangement information regarding the sound source setting sections 20-1, 20-2 and 20-3 and the listening setting section 30, and discriminates the positional relationship between the listening point and the sound sources. Also, the mixing process section 50 generates image output data indicative of the objects corresponding to the sound sources at the sound source positions as viewed from the viewpoint represented by the listening point. The mixing process section 50 outputs the generated image output data to the image display section 92 of the output apparatus 90. Thus as depicted in Subfigure (b) in FIG. 11, with the position of the listening setting section 30 regarded as the position of a listener AP, an image MS-1 of the guitar is displayed in a manner reflecting the position and direction of the sound source setting section 20-1. Also, an image MS-2 of the trumpet and an image MS-3 of the clarinet are displayed in a manner reflecting the positions and directions of the sound source setting sections 20-2 and 20-3. Further, given the mixed sound based on the sound output signal, a sound image of the guitar is displayed at the position of the image MS-1, a sound image of the trumpet at the position of the image MS-2, and a sound image of the clarinet at the position of the image MS-3. In Subfigure (b) in FIG. 11, the position of each sound image is indicated by a broken-line circle.

As described above, the present technology permits in real space easy verification of the state of arrangement of the sound sources with respect to the mixed sound. Also, free-viewpoint images of the viewpoint corresponding to the listening point may be displayed.

Figure 13:
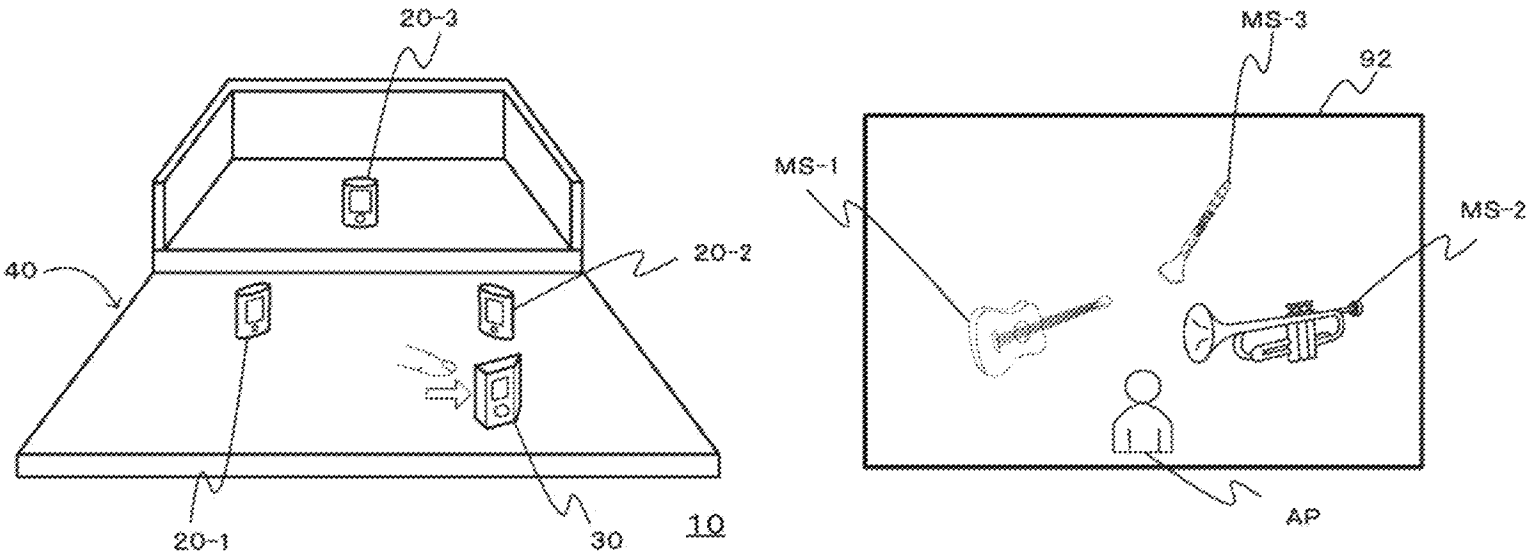
FIG. 13 is a schematic diagram depicting a typical operation in the case where the listening point is relocated.

FIG. 13 depicts a typical operation in the case where the listening point is relocated. If, for example, the user relocates the listening setting section 30 as illustrated in Subfigure (a) in FIG. 13, the listening point is relocated accordingly from the state depicted in FIG. 11.

The mixing process section 50 generates the mixed sound based on the arrangement of the sound source setting sections 20-1, 20-2 and 20-3 and of the listening setting section 30, on mixing parameters, and on listening parameters. Also, the mixing process section 50 discriminates the positional relationship between the listening point and the sound sources in accordance with the arrangement information regarding the sound source setting sections 20-1, 20-2 and 20-3 and the listening setting section 30. Further, the mixing process section 50 generates the image output data for displaying an image indicative of the objects corresponding to the sound sources at the sound source positions as viewed from the viewpoint represented by the relocated listening point. The mixing process section 50 outputs the generated image output data to the image display section 92 of the output apparatus 90. Thus as depicted in Subfigure (b) in FIG. 13, with the position of the relocated listening setting section 30 regarded as the position of the listener AP, the image MS-1 of the guitar is displayed in a manner reflecting the position and direction of the sound source setting section 20-1. Also, the image MS-2 of the trumpet and the image MS-3 of the clarinet are displayed in a manner reflecting the positions and directions of the sound source setting sections 20-2 and 20-3. Further, given the mixed sound based on the sound output signal, the sound image of the guitar is at the position of the image MS-1, the sound image of the trumpet at the position of the image MS-2, and the sound image of the clarinet at the position of the image MS-3. Because the listening setting section 30 is relocated to the right in FIG. 13, the image of Subfigure (b) in FIG. 13 has its viewpoint relocated accordingly to the right compared with the image of Subfigure (b) in FIG. 11.

In the case where the mixed sound generated by the mixing process fails to meet predetermined admissibility conditions due to the relocated listening setting section 30 being close to the sound source setting section 20-2, e.g., where the sound volume of the trumpet becomes higher than a predetermined acceptable level, the mixing process section 50 may generate and transmit a notification signal for causing the display section 32 of the listening setting section 30 to give a warning display and a notification signal for causing the sound source setting section 20-2 to give an indicator display indicating a drop of the sound volume.

Figure 14:
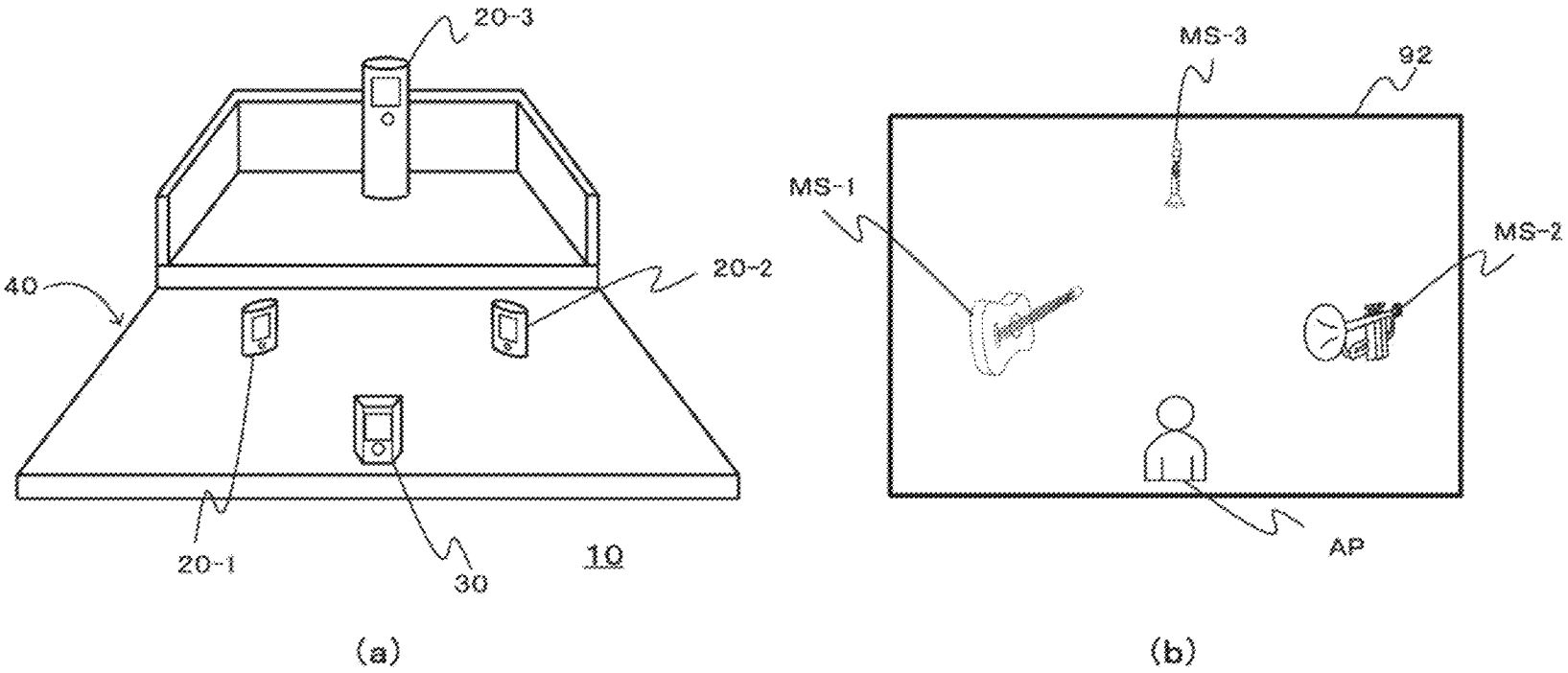
FIG. 14 is a schematic diagram depicting a typical operation in the case where a sound source is relocated.

FIG. 14 depicts arm operation example in the case where a sound source is relocated. If, for example, the user relocates the sound source setting section 20-3 as illustrated in Subfigure (a) in FIG. 14, the corresponding sound source is relocated accordingly from the state depicted in FIG. 11. FIG. 14 gives the example in which the sound source setting section 20-3 is relocated backward and elongated so as to relocate the corresponding sound source backward and upward.

The mixing process section 50 generates the mixed sound based on the arrangement of the sound source setting sections 20-1, 20-2 and 20-3 and of the listening setting section 30, on mixing parameters, and on listening parameters. Also, the mixing process section 50 discriminates the positional relationship between the listening point and the sound sources in accordance with the arrangement information regarding the sound source setting sections 20-1, 20-2 and 20-3 and the listening setting section 30. Further, the mixing process section 50 generates image output data indicative of the objects corresponding to the sound sources at the sound source positions as viewed from the viewpoint represented by the listening point. The mixing process section 50 outputs the generated image output data to the image display section 92 of the output apparatus 90. Thus as depicted in Subfigure (b) in FIG. 14, the position of the image MS-3 of the clarinet is relocated in a manner reflecting the position and direction of the sound source setting section 20-3. Also, given the mixed sound based on the sound output signal, the sound image of the clarinet is at the position of the relocated image MS-3. Because the sound source setting section 20-3 is relocated backward and elongated in FIG. 14, the image MS-3 of Subfigure (b) in FIG. 14 presents the corresponding sound source appearing to be seen from below compared with the image of Subfigure (b) in FIG. 11.

Figure 15:
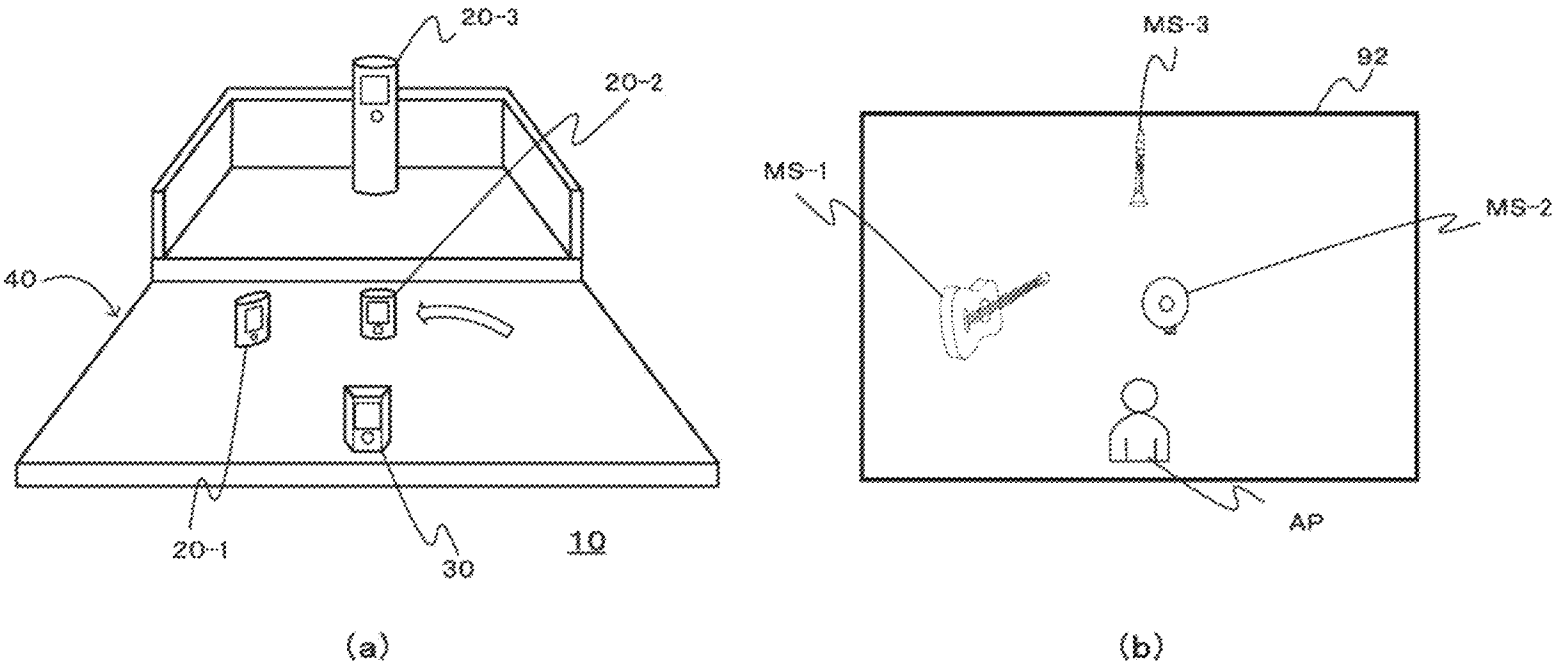
FIG. 15 is a schematic diagram depicting a typical operation in the case where sound source setting sections are automatically arranged.

FIG. 15 depicts an operation example in the case where sound source setting sections are automatically arranged. In the case where the mixing process section 50 performs an operation to relocate the trumpet to the left through the user interface section 57, the mixing process section 50 generates the mixed sound based on the arrangement of the sound source setting sections 20-1 and 20-3 and of the listening setting section 30, on the position of the relocated sound source, and on mixing parameters and listening parameters. Also, the mixing process section 50 discriminates the positional relationship between the listening point and the sound sources in accordance with the arrangement information regarding the sound source setting sections 20-1 and 20-3 and the listening setting section 30 as well as the position of the sound source relocated by the relocating operation. The mixing process section 50 generates image output data indicative of the objects corresponding to the sound sources at the sound source positions as viewed from the viewpoint represented by the listening point. The mixing process section 50 outputs the generated image output data to the image display section 92 of the output apparatus 90. Thus as depicted in Subfigure (b) in FIG. 15, the image MS-2 of the trumpet is displayed at the position of the sound source setting section 20-2 relocated by the relocating operation as illustrated in Subfigure (a) in FIG. 15, the image being relative to the viewpoint following the relocation. Also, given the mixed sound based on the sound output signal, the sound image of the trumpet is at the position of the relocated image MS-2. Furthermore, the mixing process section 50 generates a sound source relocation signal reflecting the operation to relocate the position of the trumpet to the left, and transmits the generated sound source relocation signal to the sound source setting section 20-2 associated with the trumpet.

Given the sound source relocation signal transmitted from the mixing process section 50, the arrangement relocation section 24 causes the sound source setting section 20-2 to relocate accordingly and arranges the sound source setting section 20-2 in a manner reflecting the mixed sound output from the mixing process section 50.

Carrying out the above processing permits visual discrimination of the sound source arrangement in which the mixed sound output from the mixing process section 50 is generated.

Figure 16:
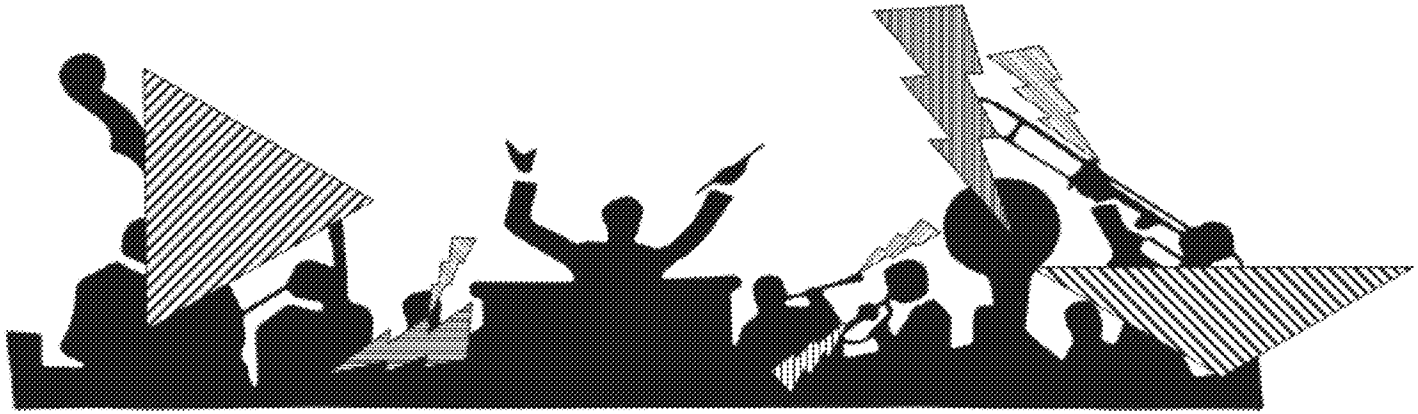
FIG. 16 is a schematic diagram depicting a typical case where sounds in space are visually displayed in a virtual space.

For image display, a user experience may be implemented in which the sounds in space are visually displayed in a virtual space. FIG. 16 depicts a typical case where in-space sounds are visually displayed in a virtual space. In the virtual space, the sound sources are represented in the guise of performers for example, with the radiation angles of the sounds visually expressed. In this case, it is difficult to present the exact radiation angle of a given sound, so that the display is given by taking advantage of the directional dependency of that sound volume. For example, in the case where the sound volume is low, the radiation angle is narrowed; where the sound volume is higher, the radiation angle is made larger. In FIG. 16, for example, triangles and lightning forms are used to express the directions in which the sounds are output. The size or the length of the shape represents the sound volume. A sound source with high directional dependency is represented by an acute-angle shape, and a sound source with low directional dependency is pictured with a wide-angle shape. Different musical instruments are represented by different colors. Different frequency bands of the sounds are represented by differences in color density or in color saturation. FIG. 16 pictures the differences in color and in density using hatched lines with different thicknesses and inclinations. Whereas FIG. 16 gives a two-dimensional image, a three-dimensional image may alternatively be presented in a virtual space.

When the sounds in space is visually displayed in a virtual space as described above, it is possible visually to verify, in the virtual space, the mixed sound generated on the basis of the real-space arrangement of the sound source setting sections 20 and of the listening setting section 30 and in accordance with the parameters set therefor without having to actually output the mixed sound.

Figure 17:
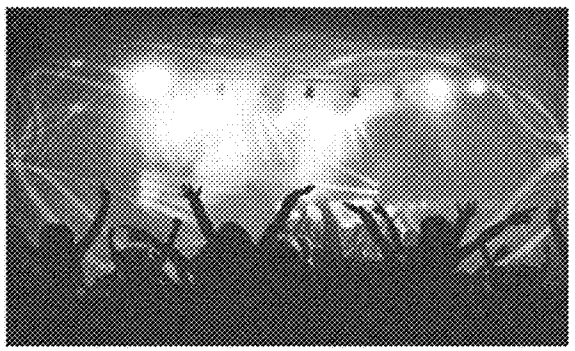
FIG. 17 is a schematic diagram depicting typical cases where reflected sounds are visually displayed in virtual spaces.
Figure 17:
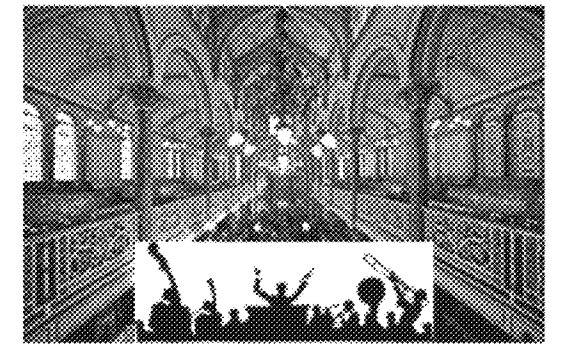
Figure 17:
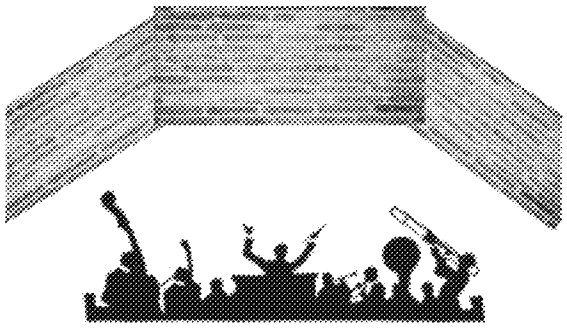
Figure 17:
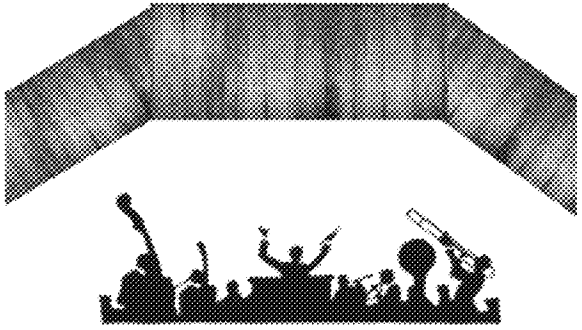

Also for image display, the reflected sounds of the sounds output from the sound sources may be visually displayed in a virtual space. FIG. 17 depicts typical cases where reflected sounds are visually displayed in virtual spaces. The intensity of a reflected sound can be recognized typically using the brightness and texture of the walls or a background image. For example, the intensity of an indirect sound is visually expressed by the background display of an image indicative of the performance inside a virtual-space building or concert venue. Since the intensity of the indirect sound is presented in the virtual space, it is not necessary to provide the exact expression; it is sufficient to give an illustrative image permitting recognition of the intensity of the indirect sound. Subfigure (a) in FIG. 17 depicts an example of sound mixing that uses a long-reverb effect with a lot of reverberation components. In this case, an image is composed to indicate as if the performance were being given in a high-ceiling hall, for example. Subfigure (b) in FIG. 17 illustrates an example of sound mixing that uses a short-reverb effect with few reverberation components. In this case, an image is composed to indicate as if the performance were being given at a small concert venue, for example.

Further, in displaying the intensity of a reflected sound, walls may be pictured in a virtual space to make their textures visually represent the reflected sound. Subfigure (c) in FIG. 17 depicts an example in which brick walls are displayed to permit recognition of an intense indirect sound. Subfigure (d) in FIG. 17 illustrates an example in which wooden walls are displayed to enable recognition of an indirect sound less intense than in the example in Subfigure (c).

When the intensity of the reflected sound is expressed using the brightness or texture of the walls as described above, it is possible visually to recognize, in a virtual space, the mixed sound generated in accordance with the mixing parameters set for the sound source setting sections 20 in real space and in keeping with the acoustic environment information from the placing table 40 without having to output the mixed sound.

The series of the processes described above may be executed by hardware, by software, or by the combination of both. Where the software-based processing is to be carried out, the programs recording process sequences may be installed into an internal memory of a computer in dedicated hardware for program execution. Alternatively, the programs may be installed into a general-purpose computer capable of performing diverse processes for execution of the programs.

For example, the programs may be recorded beforehand on such recording media as a hard disc, a SSD (Solid State Drive), and a ROM (Read Only Memory). Alternatively, the programs may be recorded temporarily or permanently on removable recording media including flexible discs, CD-ROM (Compact Disc Read Only Memory), MO (Magneto-optical discs), DVD (Digital Versatile Discs), BD (Blu-Ray Discs; registered trademark), magnetic discs, and semiconductor memory cards. Such removable recording media may be offered as so-called packaged software.

Besides being installed from the removable recording medium into the computer, the programs may be transferred in wired or wireless fashion to the computer from a download site via networks such as LAN (local area networks) and the Internet. The computer may receive the transferred programs and install the received programs onto an internal recording medium such as an internal hard disc.

The advantageous effects stated in this description are only examples and are not limitative of the present technology. There may be additional advantageous effects derived from and not covered by this description. The present technology, when interpreted, should not be limited to the embodiments discussed above. The embodiments of the technology is disclosed using examples and illustrations. It is thus evident that many alternatives, modifications and variations of the embodiments will become apparent to those skilled in the art without departing from the spirit and scope of this technology. Accordingly, the scope of the present technology should be determined by the appended claims and their legal equivalents, rather than by the examples given.

The information processing apparatus according to the present technology may be configured preferably as follows:

(1) An information processing apparatus including:

a mixing process section configured to perform a mixing process on the basis of arrangement information regarding a sound source setting section to which a sound source is assigned, setting parameter information from the sound source setting section, and arrangement information regarding a listening setting section to which a listening point is assigned, and by use of data regarding the sound source.

(2) The information processing apparatus as stated in paragraph (1) above, in which the mixing process section transmits applicable parameter information used in the mixing process regarding the sound source to the sound source setting section corresponding to the sound source.

(3) The information processing apparatus as stated in paragraph (1) or (2) above, in which the mixing process section sets parameters for the sound source setting section on the basis of metadata associated with the sound source.

(4) The information processing apparatus as stated in any one of paragraphs (1) to (3) above, in which the mixing process section stores into an information storage section the arrangement information and the applicable parameter information used in the mixing process together with an elapsed time.

(5) The information processing apparatus as stated in paragraph (4) above, in which, when performing the mixing process using the information stored in the information storage section, the mixing process section transmits either to the sound source setting section or to the listening setting section a relocation signal for relocating the sound source setting section and the listening setting section in a manner reflecting the arrangement information acquired from the information storage section.

(6) The information processing apparatus as stated paragraph (4) or (5) above, in which, using the arrangement information and the applicable parameter information stored in the information storage section, the mixing process section generates the arrangement information and applicable parameter information regarding a listening point about which the arrangement information and the applicable parameter information are not stored.

(7) The information processing apparatus as stated any one of paragraphs (1) to (6) above, in which, when receiving an operation to change the arrangement of the sound source with respect to the listening point, the mixing process section performs the mixing process on the basis of the arrangement following the changing operation, and transmits either to the sound source setting section or to the listening setting section a relocation signal for relocating the sound source setting section and the listening setting section in a manner reflecting the arrangement following the changing operation.

(8) The information processing apparatus as stated in any one of paragraphs (1) to (7) above, in which, when a mixed sound generated by the mixing process fails to meet a predetermined admissibility condition, the sizing process section transmits a notification signal indicating the failure to meet the admissibility condition either to the sound source setting section or to the listening setting section.

(9) The information processing apparatus as stated in any one of paragraphs (1) to (8) above, in which the sound source setting section and the listening setting section are physical devices placed on a placing table provided in real space.

(10) The information processing apparatus as stated in paragraph (9) above, in which either the sound source setting section or the listening setting section has a parameter setting section, a display section, and an arrangement relocation section for relocating on a placing surface of the placing table.

(11) The information processing apparatus as stated in paragraph (9) or (10) above, in which either the sound source setting section or the listening setting section is configured to be variable in shape and to generate arrangement information or setting parameter information in accordance with the shape.

(12) The information processing apparatus as stated in any one of paragraphs (9) to (11) above, further including:

a reflecting member to which a reflection characteristic is assigned, and configured to be placeable on the placing table;

in which the mixing process section performs the mixing process using arrangement information regarding the reflecting member and the reflection characteristic assigned to the reflecting member.

(13) The information processing apparatus as stated is any one of paragraphs (1) to (12) above, in which the mixing process section includes an image generation section configured to discriminate a positional relationship of the sound source setting section with respect to the listening setting section on the basis of arrangement status of the sound source setting section and the listening setting section, the image generation section further displaying an image at the position, in a virtual space, of the sound source setting section relative to the listening setting section on the basis of the result of the discrimination, the image having a texture indicative of the sound source assigned to the sound source setting section.

(14) The information processing apparatus as stated in paragraph (13) above, in which the image generation section generates the image as viewed from a viewpoint represented by the listening point.

(15) The information processing apparatus as stated in paragraph (13) or (14) above, in which the image generation section overlays an image visualizing a sound output from the sound source onto a corresponding sound source position in the image having the texture indicative of the sound source.

(16) The information processing apparatus as stated in any one of paragraphs (13) to (15) above, in which the image generation section overlays an image visualizing a reflected sound of the sound output from the sound source onto a sound-reflecting position set by the mixing process in the image having the texture indicative of the sound source.

INDUSTRIAL APPLICABILITY

According to the information processing apparatus, information processing method, and program of the present technology, sound mixing is performed using sound source data based on the arrangement information regarding the sound source setting sections to which sound sources are assigned, on the setting parameter information from the sound source setting sections, and on the arrangement information regarding the listening setting section to which the listening point is assigned. It is thus easy to mix the sounds with respect to the free listening point. This permits implementation of a system configured to output the sounds with regard to the listening point relocated to reflect the viewpoint moved in a free-viewpoint image being displayed, for example.

REFERENCE SIGNS LIST

10 Information processing apparatus
20, 20-1, 20-2, 20-3 Sound source setting section
21, 31 Operation section
22, 32 Display section
23, 33, 43, 51 Communication section
24, 34 Arrangement relocation section
25 Sound source setting control section
30 Listening setting section
35 Listening setting control section
40 Placing table
41 Acoustic environment information generation section
50 Mixing process section
52 Mixing control section
53, 55 Effecter section
54 Mixer section
56 Image generation section
57 User interface section
60 Information storage section
90 Output apparatus
91 Sound output section
92 Image display section
221 Sound volume display
222 Parameter display
401 Placing surface
402 Reflecting member

The invention claimed is:

1. An information processing apparatus comprising:

a mixing process section configured to perform a mixing process on the basis of arrangement information regarding a sound source setting section to which a sound source is assigned, setting parameter information from the sound source setting section, and arrangement information regarding a listening setting section to which a listening point is assigned, and by use of data regarding the sound source, wherein the mixing process section includes an image generation section configured to discriminate a positional relationship of the sound source setting section with respect to the listening setting section on the basis of arrangement status of the sound source setting section and the listening setting section, and wherein the mixing process section, the sound source setting section, the listening setting section, and the image generation section are each implemented via at least one processor.

2. The information processing apparatus according to claim 1, wherein the mixing process section transmits applicable parameter information used in the mixing process regarding the sound source to the sound source setting section corresponding to the sound source.

3. The information processing apparatus according to claim 1, wherein the mixing process section sets parameters for the sound source setting section on the basis of metadata associated with the sound source.

4. The information processing apparatus according to claim 1, wherein the mixing process section stores, into an information storage section having a computer-readable medium, the arrangement information and the applicable parameter information used in the mixing process together with an elapsed time.

5. The information processing apparatus according to claim 4, wherein, when performing the mixing process using the information stored in the information storage section, the mixing process section transmits either to the sound source setting section or to the listening setting section a relocation signal for relocating the sound source setting section and the listening setting section in a manner reflecting the arrangement information acquired from the information storage section.

6. The information processing apparatus according to claim 4, wherein, using the arrangement information and the applicable parameter information stored in the information storage section, the mixing process section generates additional arrangement information and additional applicable parameter information regarding an additional listening point about which the arrangement information and the applicable parameter information are not stored.

7. The information processing apparatus according to claim 1, wherein, when receiving an operation to change the arrangement of the sound source with respect to the listening point, the mixing process section performs the mixing process on the basis of the arrangement following a changing operation, and transmits either to the sound source setting section or to the listening setting section a relocation signal for relocating the sound source setting section and the listening setting section in a manner reflecting the arrangement following the changing operation.

8. The information processing apparatus according to claim 1, wherein, when a mixed sound generated by the mixing process fails to meet a predetermined admissibility condition, the mixing process section transmits a notification signal indicating the failure to meet the admissibility condition either to the sound source setting section or to the listening setting section.

9. The information processing apparatus according to claim 1, wherein the sound source setting section and the listening setting section are physical devices placed on a placing table provided in real space.

10. The information processing apparatus according to claim 9, wherein either the sound source setting section or the listening setting section has a parameter setting section, a display section, and an arrangement relocation section for relocating on a placing surface of the placing table, and wherein the parameter setting section, the display section, and the arrangement relocation section are each implemented via at least one processor.

11. The information processing apparatus according to claim 9, wherein either the sound source setting section or the listening setting section is configured to be variable in shape and to generate arrangement information or setting parameter information in accordance with the shape.

12. The information processing apparatus according to claim 9, further comprising:

a reflecting member configured to be placeable on the placing table; wherein the mixing process section performs the mixing process using arrangement information regarding the reflecting member and a reflection characteristic assigned to the reflecting member.

13. The information processing apparatus according to claim 1, wherein the image generation section is further configured to display an image at the position, in a virtual space, of the sound source setting section relative to the listening setting section on the basis of the result of the discrimination, the image having a texture indicative of the sound source assigned to the sound source setting section.

14. The information processing apparatus according to claim 13, wherein the image generation section generates the image as viewed from a viewpoint represented by the listening point.

15. The information processing apparatus according to claim 13, wherein the image generation section overlays an image visualizing a sound output from the sound source onto a corresponding sound source position in the image having the texture indicative of the sound source.

16. The information processing apparatus according to claim 13, wherein the image generation section overlays an image visualizing a reflected sound of the sound output from the sound source onto a sound-reflecting position set by the mixing process in the image having the texture indicative of the sound source.

17. The information processing apparatus according to claim 1, wherein the image generation section is further configured to display an image having a texture indicative of the sound source assigned to the sound source setting section.

18. The information processing apparatus according to claim 17, wherein the image generation section displays the textured image on the basis of the result of the discrimination.

19. An information processing method comprising:

causing a mixing process section to acquire arrangement information and setting parameter information regarding a sound source setting section to which a sound source is assigned;

causing the mixing process section to acquire arrangement information regarding a listening setting section to which a listening point is assigned; and causing the mixing process section to perform a mixing process on the basis of the acquired arrangement information and setting parameter information, and by use of data regarding the sound source, wherein the mixing process section includes an image generation section that is caused to discriminate a positional relationship of the sound source setting section with respect to the listening setting section on the basis of arrangement status of the sound source setting section and the listening setting section, and wherein the mixing process section, the sound source setting section, the listening setting section, and the image generation section are each implemented via at least one processor.

20. A non-transitory computer-readable medium having embodied thereon a program, which when executed by a computer causes the computer to execute a method, the method comprising:

acquiring arrangement information and setting parameter information regarding a sound source setting section to which a sound source is assigned;

acquiring arrangement information regarding a listening setting section to which a listening point is assigned;

discriminating a positional relationship of the sound source setting section with respect to the listening setting section on the basis of arrangement status of the sound source setting section and the listening setting section; and performing a mixing process on the basis of the acquired arrangement information and setting parameter information, and by use of data regarding the sound source, wherein the sound source setting section and the listening setting section are each implemented via at least one processor.

* * * * *